US006405804B1

(12) United States Patent
Ohmer et al.

(10) Patent No.: US 6,405,804 B1
(45) Date of Patent: Jun. 18, 2002

(54) METHOD AND APPARATUS FOR RETRIEVING A DEFLECTING TOOL

(75) Inventors: Herve Ohmer, Houston; Adrian Vuyk, Jr., Missouri City; Mark W. Brockman, Houston, all of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/521,741

(22) Filed: Mar. 9, 2000

Related U.S. Application Data

(63) Continuation-in-part of application No. 09/293,821, filed on Apr. 16, 1999, now Pat. No. 6,209,645.

(51) Int. Cl.[7] ..... E21B 7/08

(52) U.S. Cl. ..... 166/377; 166/117.6; 166/382; 175/79

(58) Field of Search ..... 166/117.6, 50, 166/377, 382; 175/79, 80, 81, 82

(56) References Cited

U.S. PATENT DOCUMENTS

| | | | | |
|---|---|---|---|---|
| 2,132,061 | A | * 10/1938 | Walker | 166/117.6 |
| 3,908,759 | A | 9/1975 | Cagle et al. | |
| 4,266,621 | A | 5/1981 | Brock | |
| 4,452,321 | A | 6/1984 | Erikson | |
| 4,512,419 | A | 4/1985 | Rowley et al. | |
| 4,512,423 | A | 4/1985 | Aumann et al. | |
| 4,566,545 | A | 1/1986 | Story et al. | |
| 4,625,479 | A | 12/1986 | Giguere | |
| 4,694,916 | A | 9/1987 | Ford | |
| 4,702,050 | A | 10/1987 | Giguere | |
| 4,710,074 | A | 12/1987 | Springer | |
| 4,955,438 | A | 9/1990 | Juergens et al. | |
| 5,010,955 | A | 4/1991 | Springer | |
| 5,027,914 | A | 7/1991 | Wilson | |
| 5,431,219 | A | 7/1995 | Leising et al. | |
| 5,431,220 | A | 7/1995 | Lennon et al. | |

(List continued on next page.)

OTHER PUBLICATIONS

Defourny, P.M. and Abbassian, Fereidoun: *Flexible Bit: A New Antivibration PDC–Bit Concept*; SPE Drilling & Completion; Dec. 1998; p. 237–242.

*Primary Examiner*—Hoang Dang
(74) *Attorney, Agent, or Firm*—Trop, Pruner & Hu P.C.

(57) ABSTRACT

A method and apparatus for predictable downhole milling of a casing window having predetermined location, orientation, dimension and contour geometry. An elongate substantially rigid milling shaft has at least one casing window milling element in fixed relation therewith and has a pilot mill in articulated and rotary driven connection with the milling shaft. The milling shaft is in articulated and rotary driven connection with a rotary drive mechanism. The articulated connection of the pilot mill and milling shaft may incorporate an articulation control system to permit the pilot mill to be maintained substantially coaxial with the milling shaft so that its trajectory at a predetermined stage of window milling can be controlled by the milling shaft when positive guiding by a deflecting tool can no longer be ensured. The deflecting tool is adapted to be set within the well casing and defines an inclined pilot mill guide surface for guiding the pilot mill along a predetermined inclined trajectory for milling into the well casing. The deflecting tool incorporates a generally cylindrical bearing for guiding and providing rotational stabilization to the pilot mill during initial window milling to ensure the accuracy of the pilot bore being milled through the well casing and into the surrounding formation. During window milling the pilot mill guides the milling shaft so that the string mills of the milling shaft remove a portion of the pilot mill guide bearing and form a guide face of predetermined contour on the deflecting tool for guiding other tools through the casing window and into the lateral bore. The deflecting tool may be of tubular geometry so as to guide not only the pilot mill but also the string mill and may also receive the rotary drive motor for guiding and stabilizing thereof.

25 Claims, 15 Drawing Sheets

U.S. PATENT DOCUMENTS 5,474,133 A 12/1995 Sieber
5,535,822 A 7/1996 Schock et al.
5,636,692 A 6/1997 Haugen
5,657,820 A 8/1997 Bailey et al.
5,778,980 A 7/1998 Comeau et al.
5,829,518 A 11/1998 Gano et al.
5,947,201 A 9/1999 Ross et al.
5,957,221 A 9/1999 Hay et al.
6,006,844 A 12/1999 Van Puymbroeck et al.
6,019,173 A 2/2000 Saurer et al.
6,209,636 B1 * 4/2001 Roberts et al. ..... 166/117.6
6,279,659 B1 * 8/2001 Brunet ..... 166/313

* cited by examiner

METHOD AND APPARATUS FOR RETRIEVING A DEFLECTING TOOL

This application is a continuation-in-part and claims priority of U.S. patent application Ser. No. 09/293,821 filed by Ohmer on Apr. 16, 1999, now U.S. Pat. No. 6,209,645.

BACKGROUND OF THE INVENTION

1. Field of Invention

The present invention relates generally to methods and apparatus for milling windows in well casings in the downhole environment whenever the trajectory of a well should be modified after a casing or liner has been set in a well or when one or a plurality of branches are built from a parent well. More particularly, the present invention concerns a method and apparatus for milling casing windows which ensures predictable milling so that the resulting casing window will be of predetermined dimension, contour geometry, location and orientation. Even more specifically, the present invention provides for stabilized rotation and efficiently controlled guiding of a pilot mill having articulated and rotary driven relation with a substantially rigid string mill, especially during initiation of casing milling, to ensure efficient deflector controlled guiding of the pilot mill and guiding of the string mills by the pilot mill, to ensure precisely controlled formation of a casing window by the pilot mill and string mills. The present invention also concerns a casing window milling system incorporating an articulated pilot mill having the capability for controlling its amplitude of relative misalignment with a substantially rigid milling shaft and having rotary driven relation with the milling shaft during initiation of casing milling and during initial pilot boring into the subsurface formation from the casing window.

2. Related Art

Casing windows are required whenever the trajectory of a well should be modified after a casing or a liner has been set in a well or when one or a plurality of branches are built from a parent well.

A casing window is generally performed with a combination of mills mounted on a mandrel at the bottom end of a drill string and wedging between the casing and a deflection tool called the whipstock. The whipstock is generally set in the hole in combination with the first milling run. The window may be completed in one single operation in the hole or in multiple runs. The peripheral surface of mills is generally covered with abrasive or cutting inserts made of hard material such as sintered tungsten carbide compounds brased on a steel mandrel. The hardness of the whipstock is generally designed so minimum wear will be generated by the rotation of mills peripheral surface onto the whipstock face while the assembly is pushed and rotated against the casing wall under deflecting action of the whipstock. However the milling action generally results from unbalanced pressures between respectively the mill(s) and the whipstock on one hand and the mill(s) and the casing wall on the other hand.

In high inclination condition, the whipstock face is generally oriented upward and therefore forces applied by the mill(s) onto the whipstock face increase with the increasing weight component of the milling string. Although a whipstock is expected to support some milling damage, how much whipstock material is left after milling has been preformed is difficult to predict. In such case the success of whipstock retrieval may become risky and lead to lost time and additional contingency and sometimes to the loss of the bottom section of the well.

The lack of control on the window geometry is another major disadvantage of conventional window milling techniques and makes some lateral branching techniques inapplicable or more complex. Most windows show a lower section directed sideways with respect to the hole axis. How much this "walk away" affects a window is hardly predicable and depends on several factors like well inclination, pilot mill size and shape, mill cutting structure, weight on bottom hole assembly, whipstock hardness and orientation.

When the formation surrounding the well casing being penetrated by the window bore is well consolidated, it is desirable that the pilot mill have a geometry enabling it to be efficiently guided along an intended trajectory by the wall surface of the wellbore being formed. When the formation surrounding the wellbore is not well consolidated, a pilot mill which has a freely articulated and rotary driven connection with a substantially rigid milling shaft could be subject to forces that might tend to change its course from the intended trajectory. If the pilot mill should be suddenly articulated when encountering some unusual structure in the downhole environment, the pilot mill or its articulated connection with the milling shaft could become damaged, perhaps to the extent of being separated from the milling shaft. It is desirable therefore to provide a casing window milling system having an articulated pilot mill and also having a mechanism for controlling the amplitude of relative misalignment of the pilot mill relative to the axis of rotation of the milling shaft. This pilot mill amplitude control feature will permit the pilot mill to be efficiently deflected so as to follow the slope of the deflecting tool without damaging the deflecting tool and will permit the pilot mill to be constrained in a coaxial relationship with the milling shaft so as to be guided by the milling shaft after the pilot mill has passed a point on the deflecting tool where self guiding of the pilot mill can no longer be ensured. Thus it is desirable to provide a casing window milling tool which incorporates a locking or restraining mechanism which can be actuated mechanically or hydraulically to lock the pilot mill in co-axial, stabilized relation with the milling shaft.

SUMMARY

It is a primary feature of the present invention to provide a novel method and apparatus for predictable milling of casing windows which employs a rotary milling tool having an articulated pilot mill provided with cutting means only on its forward axial end so that the pilot mill is capable of cutting only on the forward axial end thereof and will not cut or substantially erode away a deflection element that is utilized to guide the pilot cutter;

It is another feature of the present invention to provide a novel method and apparatus for predictable milling of casing windows which utilizes an articulated pilot mill not only for pilot hole cutting but also for efficiently guiding other milling cutters of the apparatus during milling activities so that the geometry and location of the resulting casing window will conform specifically to plan and will not be varied by other factors during milling;

It is also a feature of the present invention to provide a novel method and apparatus for predictable milling of casing windows which employs guide means such as a tubular guide bearing to render the pilot mill extremely stable during initial forming of the casing window;

It is another feature of the present invention to provide a novel method and apparatus for predictable milling of casing windows which utilizes an articulated pilot mill having a non-milling periphery for guided engagement with an inclined guide surface of a deflecting device and having a forward milling end for milling a pilot window bore through the well casing and into the surrounding formation;

It is also a feature of the present invention to provide a novel method and apparatus for predictable milling of casing windows wherein a pilot mill is employed which has articulated driven connection with a substantially rigid string mill and which is adapted for non-milling engagement with an inclined guide surface and is adapted for pilot window milling engagement with the casing of a well;

It is a feature of the present invention to provide a well casing milling system incorporating a pilot mill having articulated driven connection with a substantially rigid string mill shaft wherein the articulated driven connection comprises a universal joint which transmits torque and axial load from the substantially rigid string mill shaft to the pilot mill;

It is also a feature of the present invention to provide a novel casing window milling system having a pilot mill that has articulated rotary driven connection with a substantially rigid milling shaft by means of a universal joint and wherein the universal joint incorporates an articulation control mechanism for adjusting the amplitude of angular misalignment of the pilot mill relative to the milling shaft between a maximum allowable angle and a coaxial relationship and for locking the pilot mill at the selected amplitude of angular misalignment;

It is another feature of the present invention to provide a well casing milling system incorporating a pilot mill and a substantially rigid string mill shaft and means for decoupling the bending moment that would otherwise be transmitted between the pilot mill and string mill shaft as the pilot mill is diverted from the longitudinal axis of the well casing to the inclined path of the guide surface of the deflector tool;

It is an even further feature of the present invention to provide a well casing milling system incorporating a deflecting tool having an upper guide bearing to provide an articulated rotary driven pilot mill of a milling assembly with precise guiding during initial casing window milling to ensure rotary stabilization of the pilot mill and ensure proper orientation and direction of the pilot bore;

It is a feature of the present invention to provide a well casing milling system incorporating a pilot mill having articulated driven connection with a substantially rigid string mill shaft and wherein the articulated rotary driving connection defines a flow passage through which a suitable fluid may be pumped for cooling or otherwise enhancing the casing window milling operation;

It is a feature of the present invention to provide a well casing milling system incorporating a pilot mill having articulated driven connection with a substantially rigid string mill shaft and wherein the pilot mill defines a non-milling substantially cylindrical guiding periphery and the articulated rotary driving connection defines the axis of rotation of the pilot mill and is located within and intermediate the axial length of the pilot mill to provide for stability and guidance thereof;

It is another feature of the present invention to provide a well casing milling system incorporating a deflecting tool which is set within the well casing and which defines an inclined guide surface for non-milling engagement by an articulated pilot mill of a casing window milling assembly and which deflecting tool defines a passage through which fluid may be caused to circulate and well tools may be passed for conducting other well activities with the deflecting tool in place or for retrieval of the deflecting tool from the well casing;

It is a feature of the present invention to provide a well casing milling system incorporating a pilot mill having articulated driven connection with a substantially rigid string mill shaft and employing a rotary drive means having articulated driving connection with the substantially rigid string mill shaft, which rotary drive means may take the form of a positive displacement motor, turbine or other equivalent power source and which rotary drive means may be rotated by a drill string for enhancing the power and/or speed of the milling system;

It is another feature of the present invention to provide a novel method and apparatus for predictable milling of casing windows and has a pilot mill which has articulated driven connection with a substantially rigid milling shaft having string mills and which provides radial force to the rigid shaft and string mills causing the string mills to penetrate into the casing without substantial wear of the guide face of the deflection tool;

It is also a feature of the present invention to provide a novel method and apparatus for predictable milling of casing windows which incorporates a deflecting tool which is set within the well casing and a milling assembly having a substantially rigid milling shaft and a pilot mill having articulated rotary driven connection with the milling shaft and wherein the milling assembly and the deflection tool may be releasably interconnected during running operations to ensure single pass installation and desired initial relative positioning of both the deflecting tool and milling assembly before the casing window milling operation is initiated;

It is an even further feature of the present invention to provide a novel method and apparatus for predictable milling of casing windows which employs an elongate milling tool having sufficient stiffness to prevent or minimize its deflection during milling so that the resulting casing window will have precisely and predictably determined characteristics of window dimension, window contour geometry and location;

It is also a feature of the present invention to provide a novel method and apparatus for predictable milling of casing windows which employs deflection tool establishing a substantially tubular pilot mill guide or pilot mill and rotary drive motor guide for guiding the articulated pilot of the window milling tool and wherein a portion of the tubular pilot guide is partially milled by succeeding window mills to form the deflecting tool with a predictable guide surface geometry that is suitable for guiding well tools from the main well bore through a casing window and into a lateral bore; and It is an even further feature of the present invention to provide a novel method and apparatus for predictable milling of casing windows which incorporates a deflecting tool and milling tool which enable guided movement of the milling tool and its rotary drive motor and rotary stabilizer within a guide passage of the deflecting tool; and It is also a feature of the present invention to provide a novel method and apparatus for predictable milling of casing windows which is design to enable a deflecting tool and a casing window milling tool to be run into a well casing as a unitary assembly and after milling of a casing window, to be extracted from the well casing as an assembly.

Briefly, a downhole casing window milling assembly embodying the principles of the present invention is composed of a rotary positive displacement motor, a hollow rotary driving articulation connected to the motor bit box on its upper end and to a substantially rigid milling shaft on its lower end, a pilot mill having articulated connection with the substantially rigid milling shaft, a deflection tool releasably connected to the bottom of the milling tool and an anchoring device at the very bottom which additionally provides for location and orientation of the casing window milling system within the well casing.

The rotary positive displacement motor drives the milling assembly through an articulated joint such as a universal joint or a short flex joint which also defines a flow passage. The purpose of such articulation or short flex joint is to decouple, cancel or minimize bending moments that could be transmitted by the milling assembly to the motor bearings while still allowing fluid to circulate to the bottom of the milling assembly. If desired, the rotary drive motor can eventually include two power sections to provide additional torque without creating additional conveyance constraints in high dog leg severity wells.

The downhole motor can be also a turbine or other alternative downhole rotary power generation wherever the mechanical power source will be most appropriate without noticeably affecting the basic benefit of the milling equipment. The downhole motor and its rotational stabilizer can also be adapted for passing through the deflecting tool and to be guided by the deflecting tool when the deflecting tool incorporates a tubular guide.

Although use of downhole rotating power source such as positive displacement motors provide better milling performance in deviated or horizontal wells, the bottom milling tool may be alternatively powered by or in combination with a conventional rotary drill string. While using a downhole power source, the drill string may be rotated to provide additional mechanical power to the milling tool and also to minimize the effect of dragging forces and thus provide better control of milling tool penetration.

The casing window milling assembly is composed of a plurality of string mills mounted on a substantially rigid hollow milling shaft. A pilot mill is mounted for articulation at the bottom end of the milling shaft and is rotated and moved axially by the milling shaft. The pilot mill is of generally cylindrical configuration and defines a generally cylindrical outer peripheral surface which establishes a non-milling, guided relationship with the inclined guide surface of the deflecting tool. The pilot mill has a milling face only at its forward end and has no abrasive material on its outer periphery so that the deflecting tool is not subject to significant milling action by the pilot mill as the pilot mill is rotated and guided during window milling. The pilot mill is articulated within a small angular amplitude relative to the milling shaft so it can spin along an axis parallel to the inclined guide face of the deflection tool and be guided without milling the guide face of the deflection tool, unlike conventional casing window milling tools which typically having milling contact with the deflection tool and thus tend to remove at least a portion of the guide face during milling. The milling shaft is provided with at least one and preferably two or more string mills, such as a gauging mill and a reaming mill, for example, which are each typically of greater diameter than the diameter of the pilot mill. The initial string mill is mounted to the milling shaft at a relatively short distance from the pilot mill so most of the opening milled in the well casing will be made with the initial string mill. Optionally, one or several reaming mills can also be mounted on the milling shaft above the first string mill. In most common situations, casing windows are of full size, meaning that the diameter of a cylinder passing through the window is substantially equal to the casing inside diameter. In this case the outside diameter of the pilot mill is smaller than that of the string mill(s) which typically have a diameter that is very close to the drift diameter of the casing. The milling system can incorporate a locking or restraining mechanism for controlling the amplitude of misalignment of the pilot mill relative to the milling shaft from a coaxial relationship to a relationship permitting a maximum degree of allowable articulation. This feature permits the pilot mill to be efficiently guided along the slope of the deflecting tool or whipstock during initial casing window milling and permits guiding of the pilot mill to be controlled by the milling shaft when the pilot mill has moved along the guiding face of the whipstock to a point that its efficient self guiding can no longer be ensured. In one suitable form the locking or restraining system may take the form of a hydraulic piston actuated mechanism which is maintained in a release position by captured hydraulic fluid within a closed chamber. The hydraulic fluid may be released in any suitable manner, such as by breaking of a frangible element or by pressure responsive opening of a release valve to permit spring urged movement of the hydraulic piston to a position causing restraint or locking of the articulated connection between the pilot mill and the milling shaft. When so restrained, the pilot mill will be guided along the intended trajectory by its coaxial or axial misalignment controlled relation with the milling shaft and with its trajectory being controlled by the milling shaft. Moreover, under conditions where unusual forces are encountered that might tend to deflect the pilot mill from its intended course the locking or restraining mechanism will ensure that the pilot mill will maintain its intended trajectory.

In the case of undersize windows, meaning that the diameter of a cylinder passing through the window is substantially smaller than the casing inside diameter, the diameter of the pilot mill may be equal to the diameter of the string mills. This is generally the case of window milling in a production liner/casing which requires the milling tool to be passed through a production tubing.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an elevation view of a casing window milling tool constructed in accordance with the teachings of the present invention and having parts thereof broken away and shown in section and further showing the pilot mill thereof in deflecting engagement with an inclined guide of a deflection tool;

FIG. 2 is a sectional view of a well casing and casing window deflection tool and showing the casing window milling tool of the present invention located within the deflection tool and further showing pilot hole milling and staged casing window milling;

FIG. 3 is a sectional view showing a deflection tool and further showing the pilot mill of the milling tool of FIGS. 1 and 2 being located within a substantially tubular guide bearing of the deflection tool;

FIG. 4 is a sectional view taken along line 4—4 of the deflection tool of FIG. 3 showing the geometry of the guiding face of the deflection tool before milling has taken place;

FIG. 5 is a sectional view taken along line 4—4 of the deflection tool of FIG. 3 showing the geometry of the guiding face of the deflection tool after casing window milling has been completed;

Figure 3:
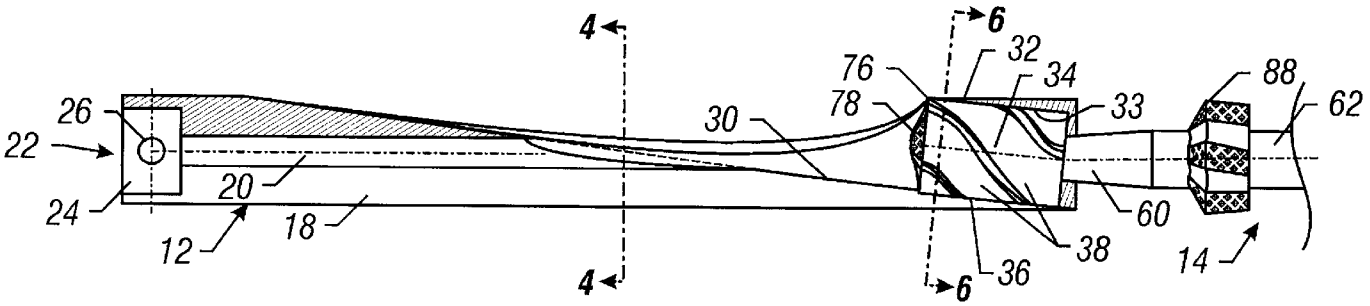
Figure 7:
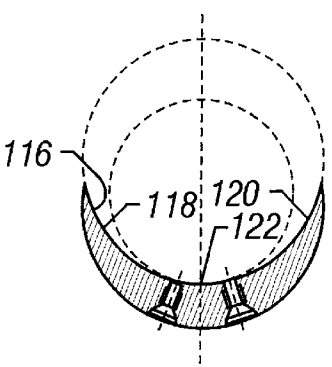
Figure 6:
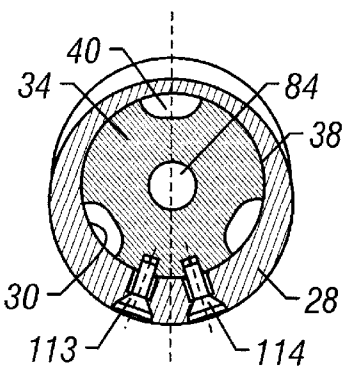
Figure 8:
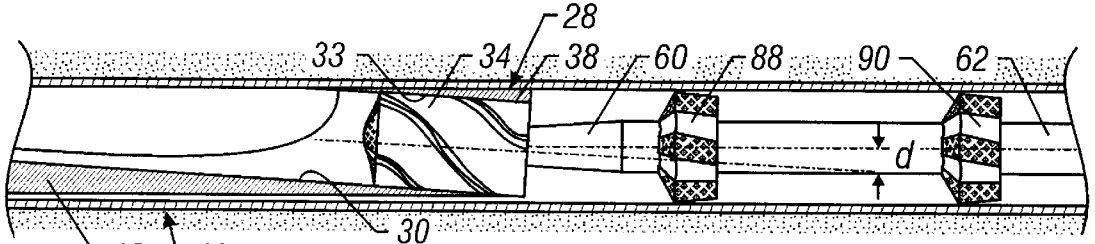
Figure 9:
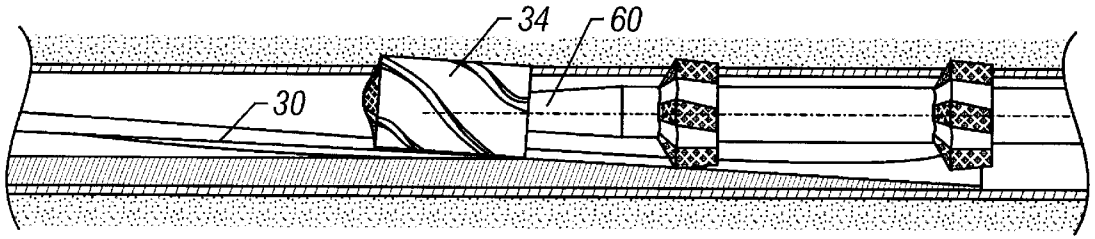
Figure 10:
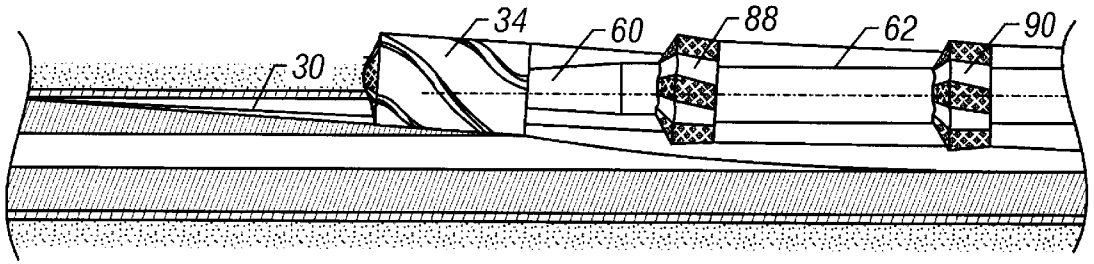
Figure 11:
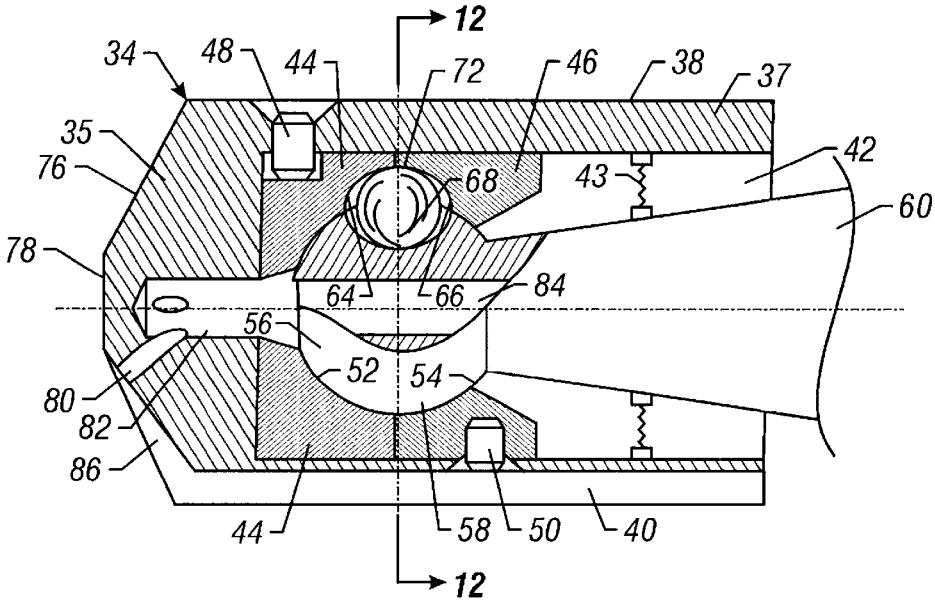
Figure 12:
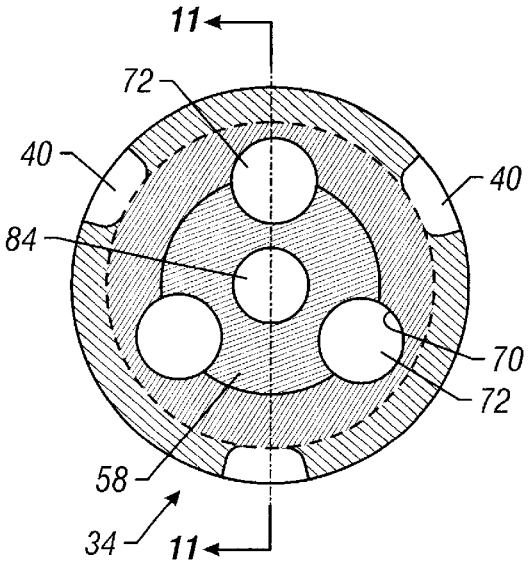
Figure 13:
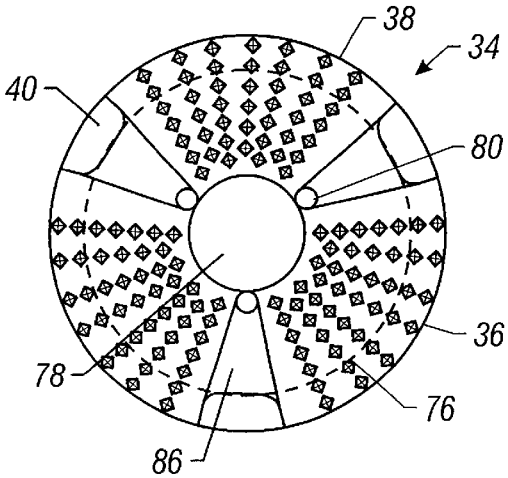
Figure 14:
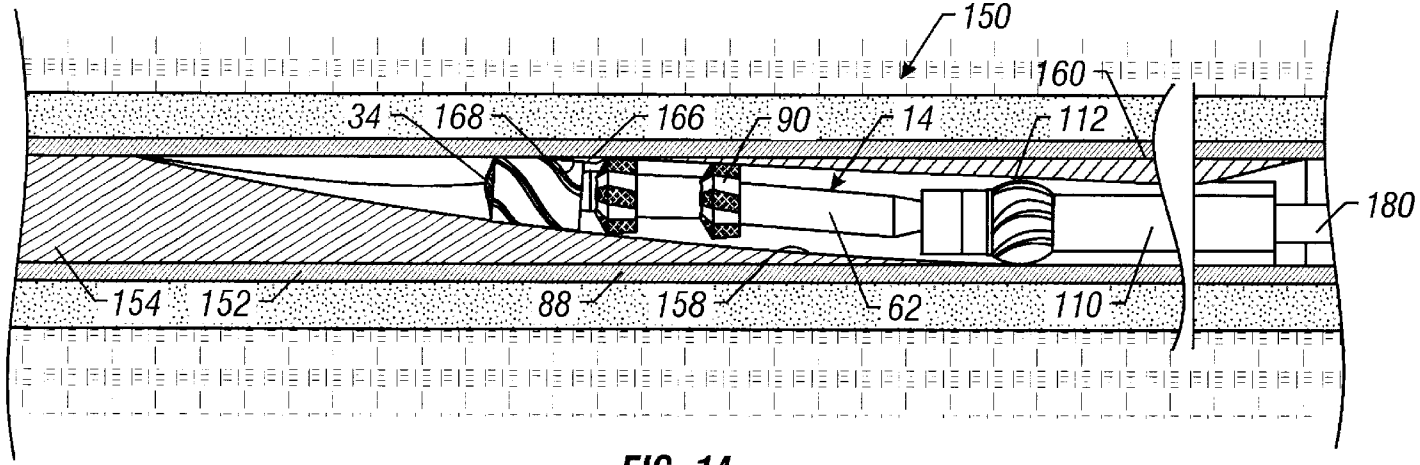
Figure 15:
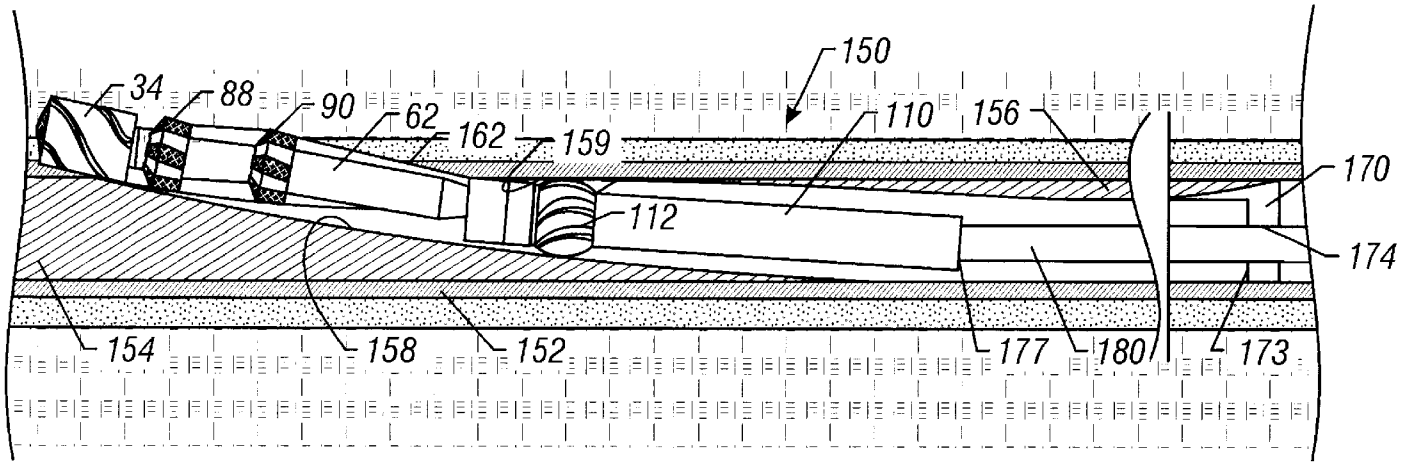
Figure 16:
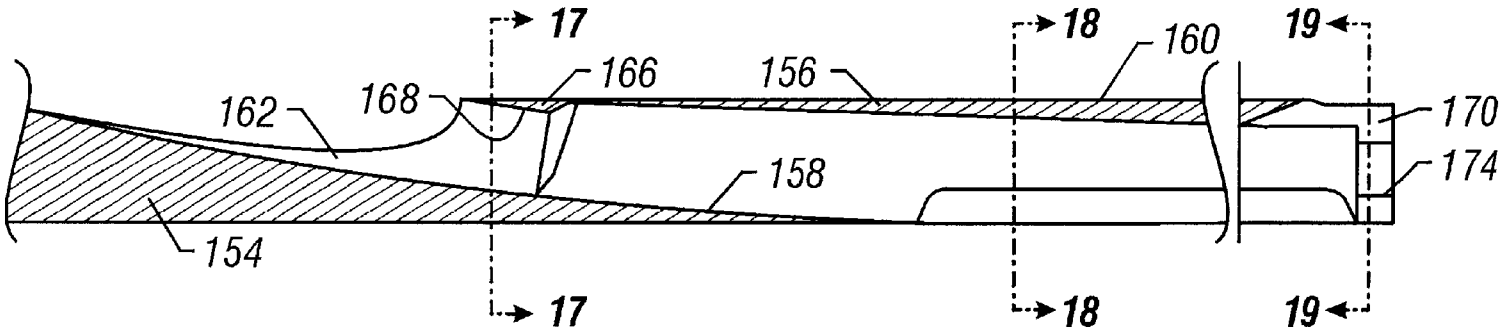
Figure 18:
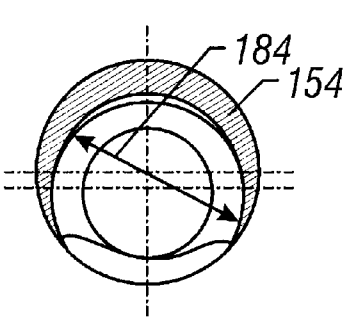
Figure 19:
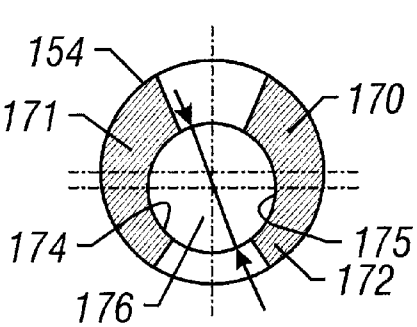
Figure 17:
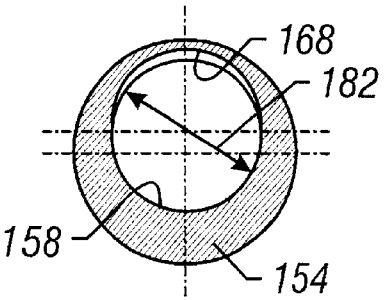
Figure 20:
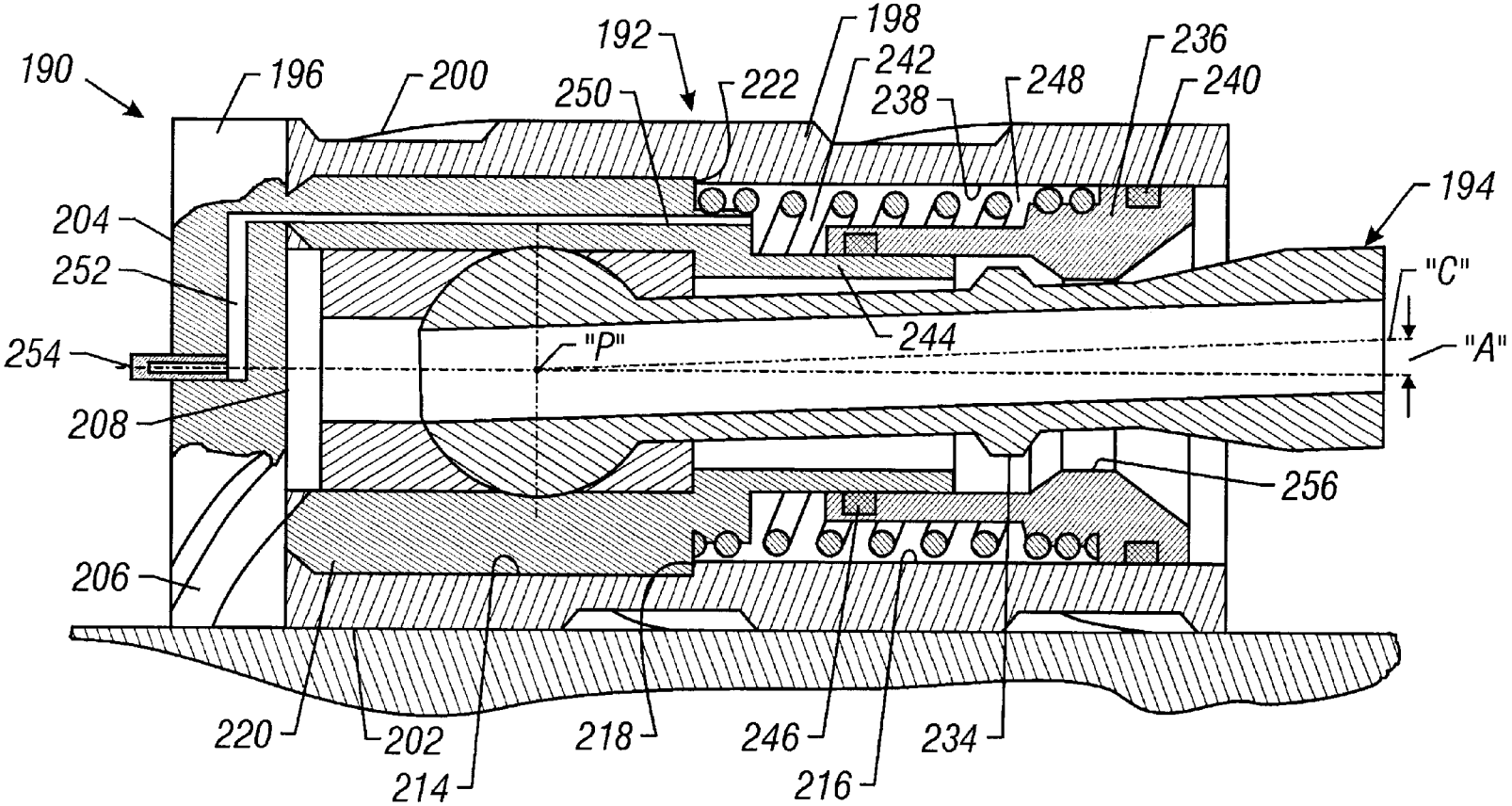
Figure 21:
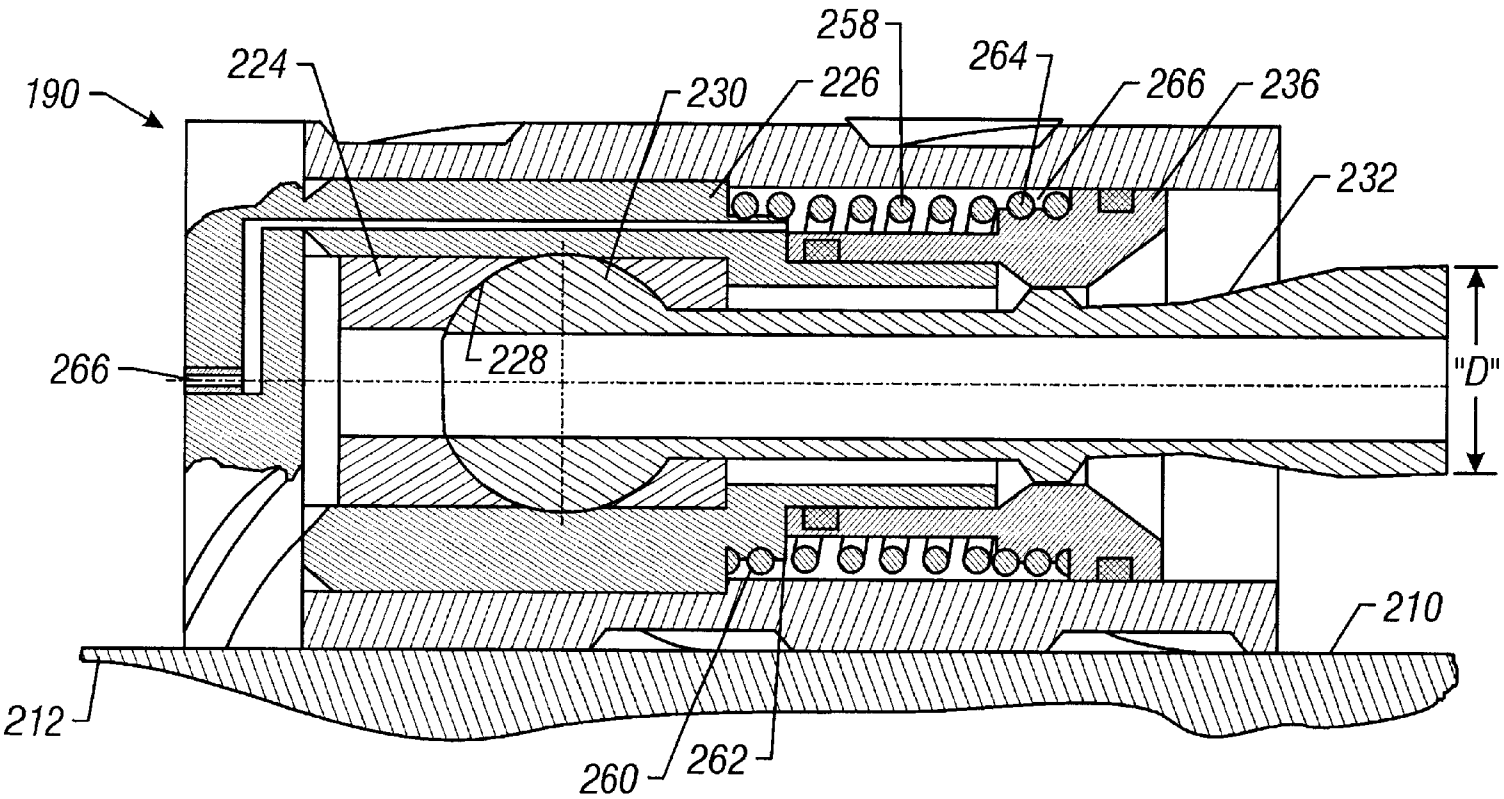
Figure 22:
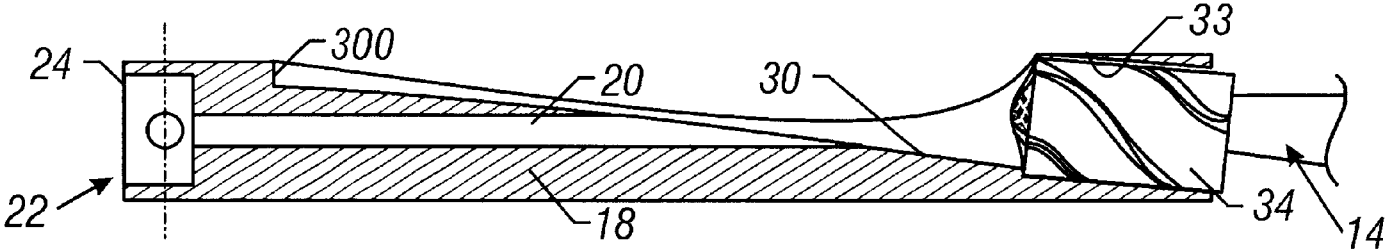
Figure 23:
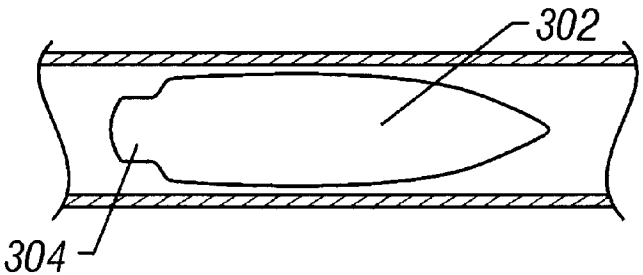
Figure 24:
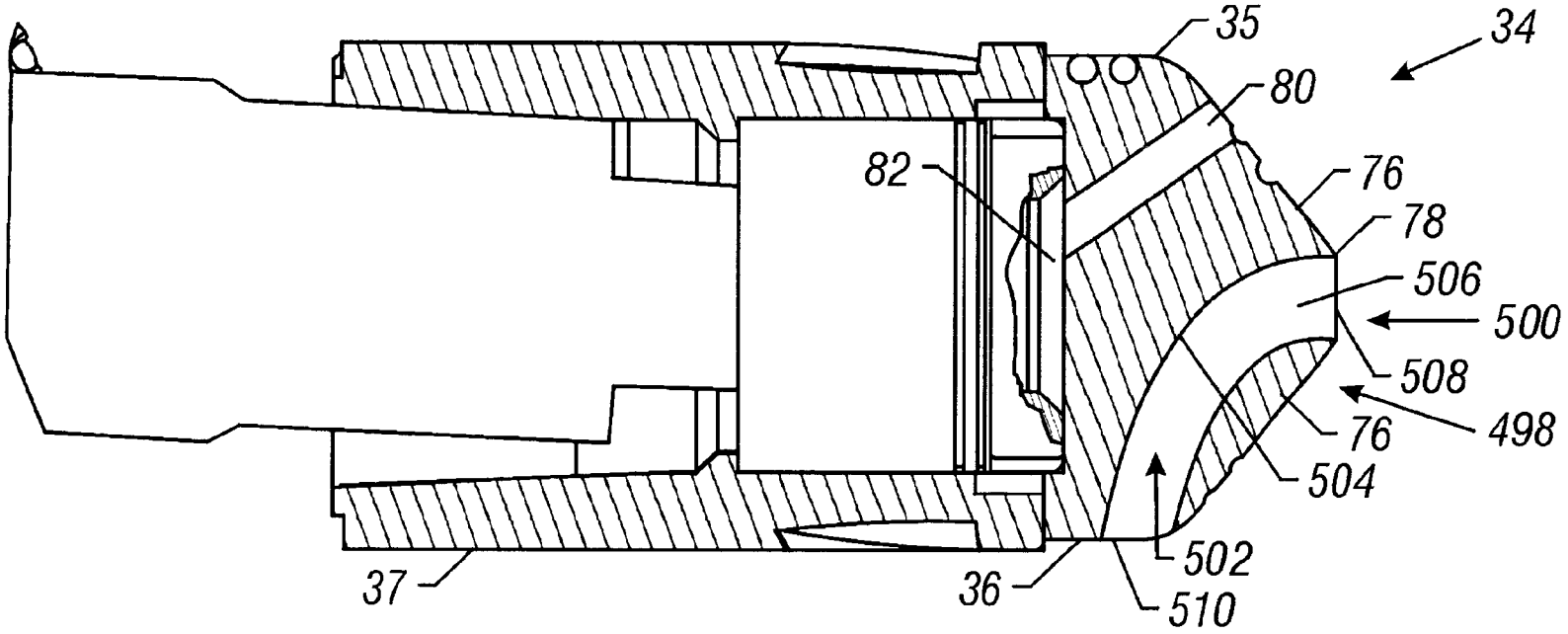
Figure 25:
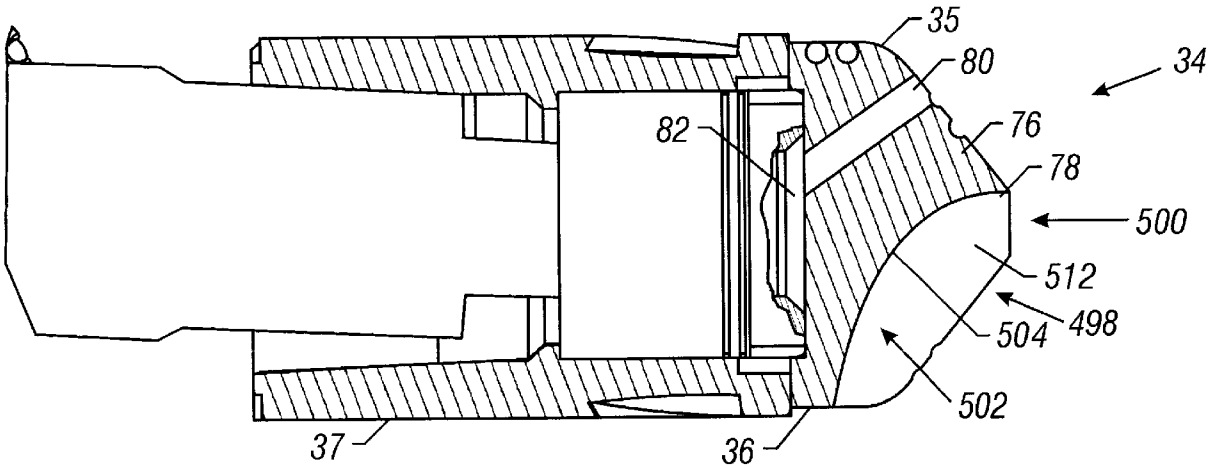
Figure 26:
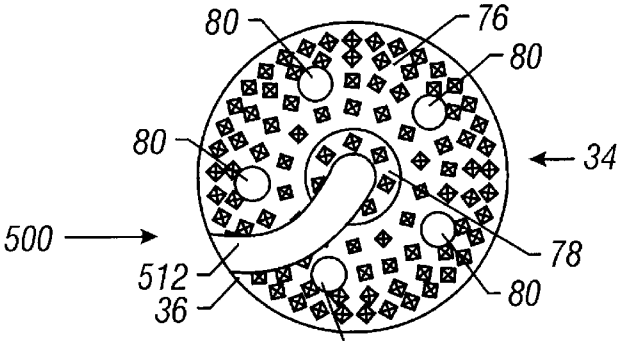
Figure 27:
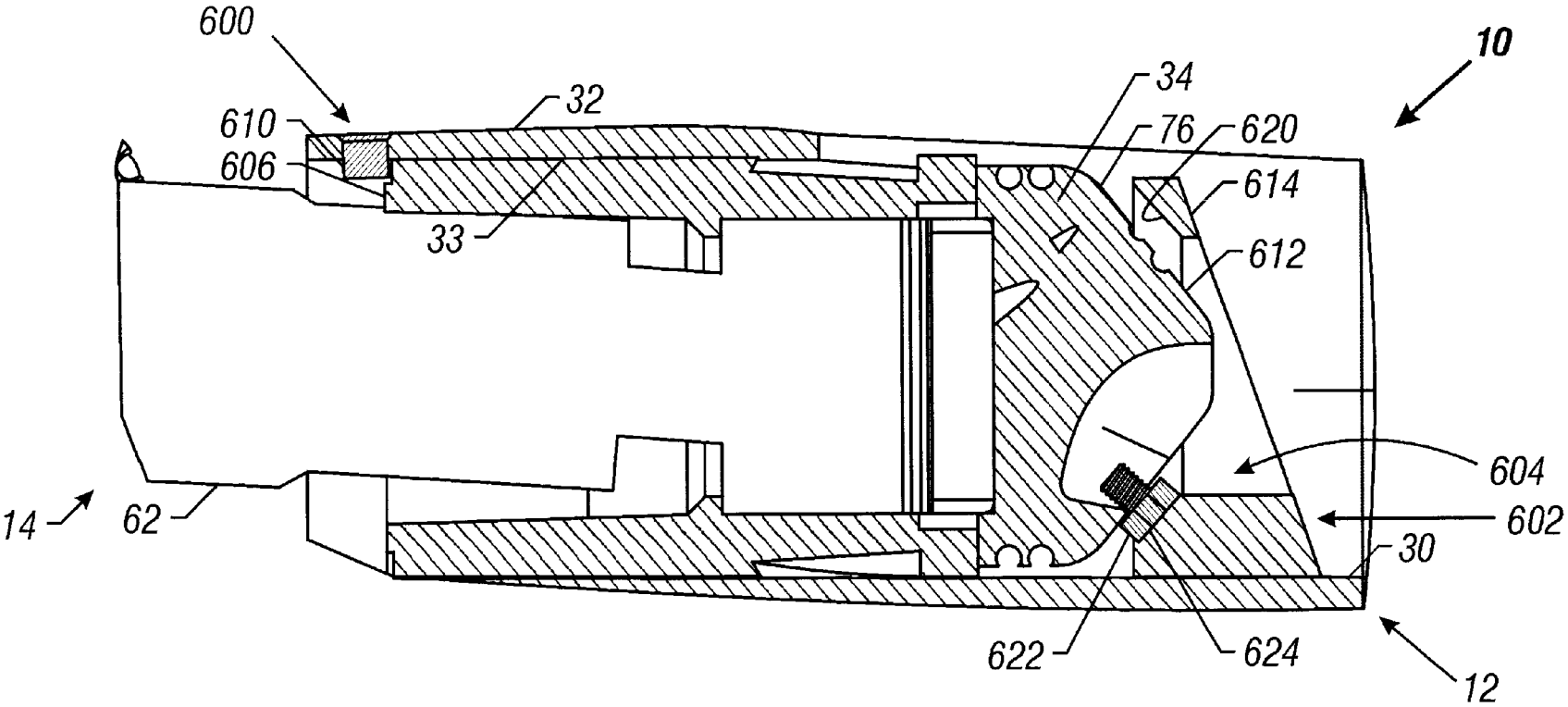
Figure 28:
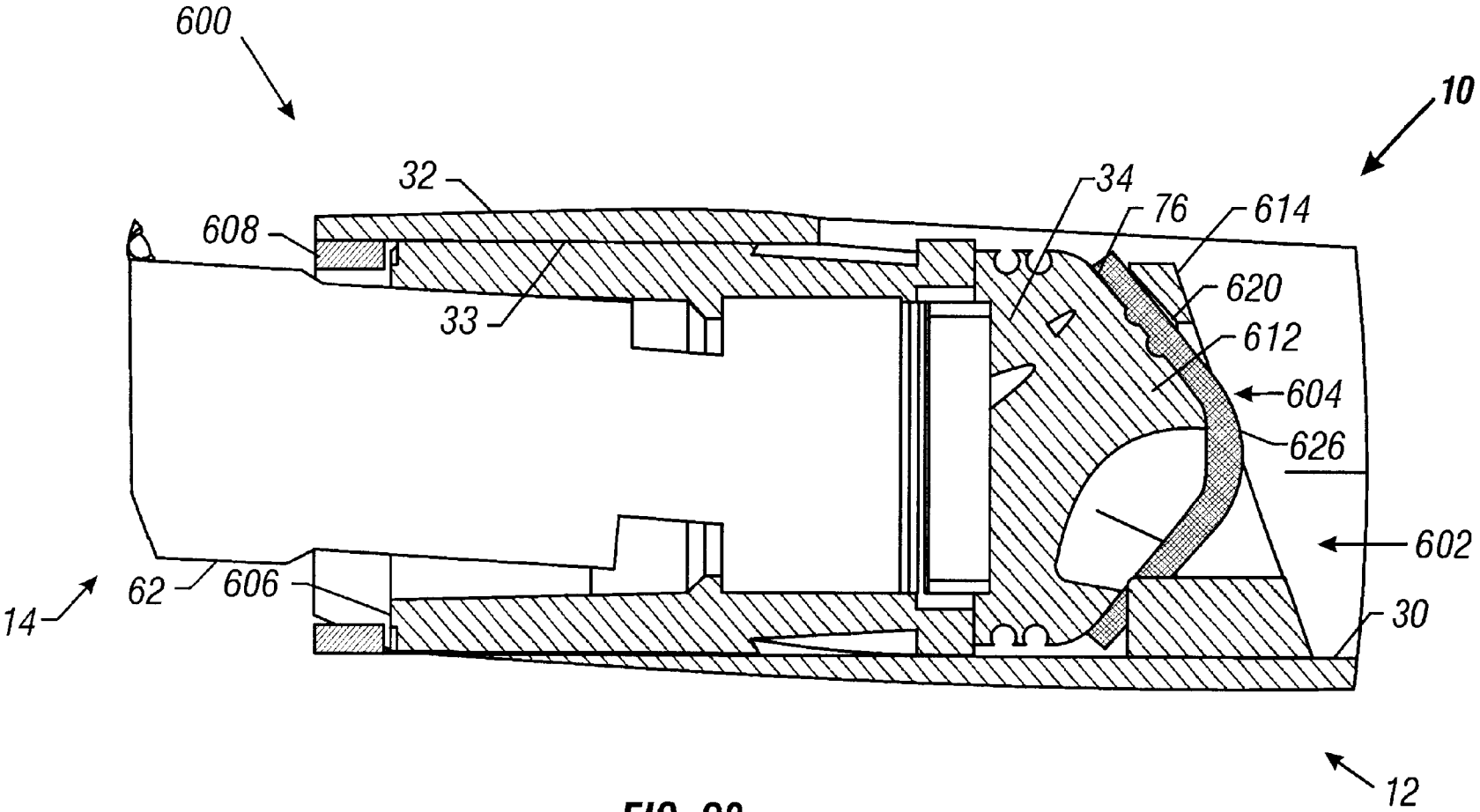
Figure 29:
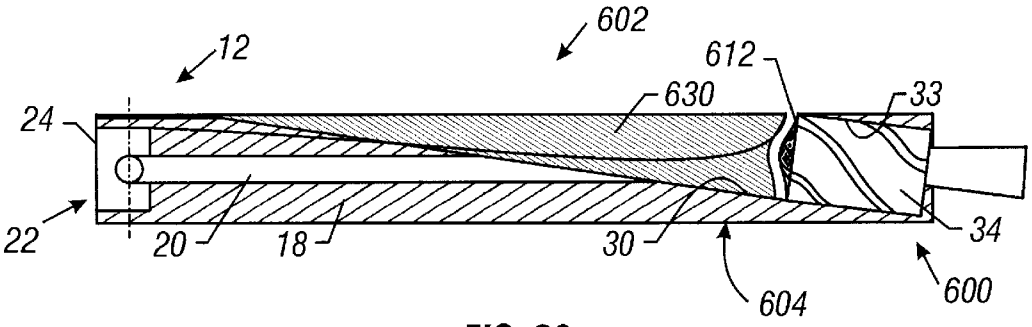
Figure 30:
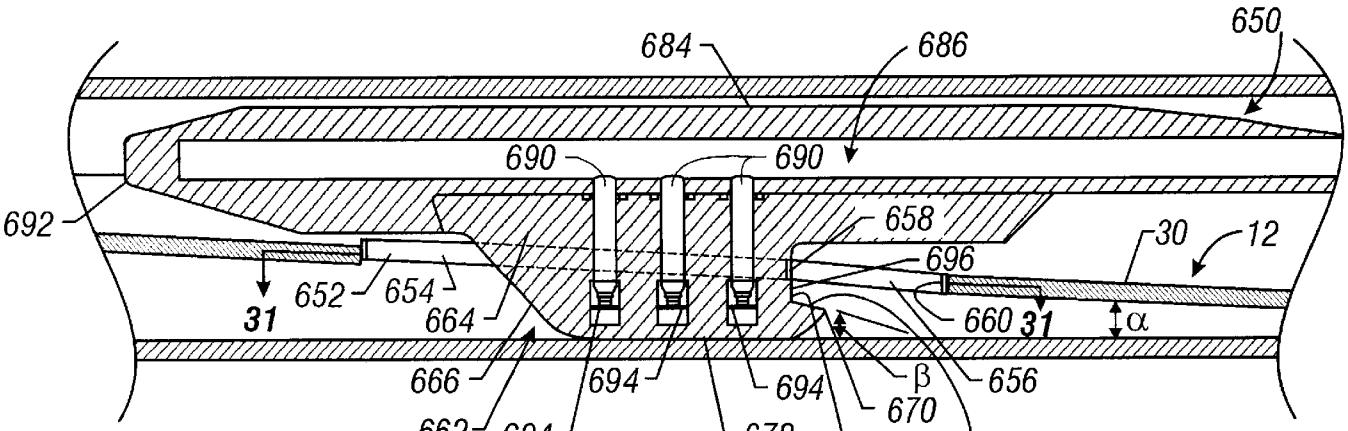
Figure 31:
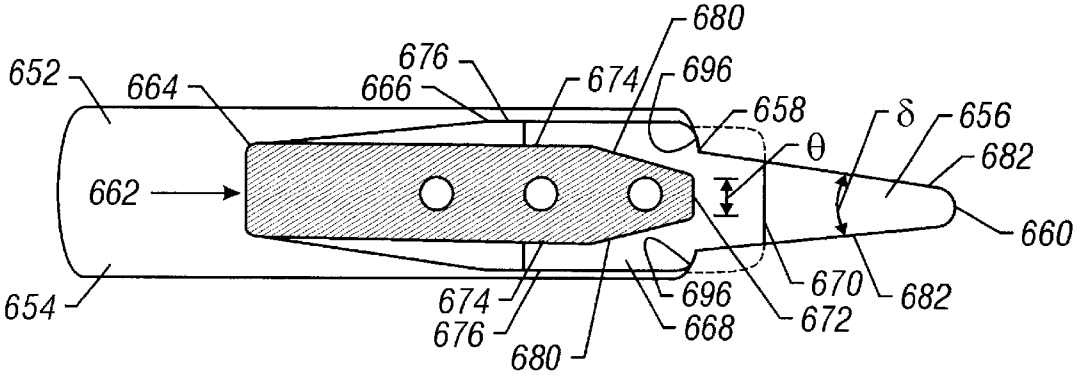
Figure 32:
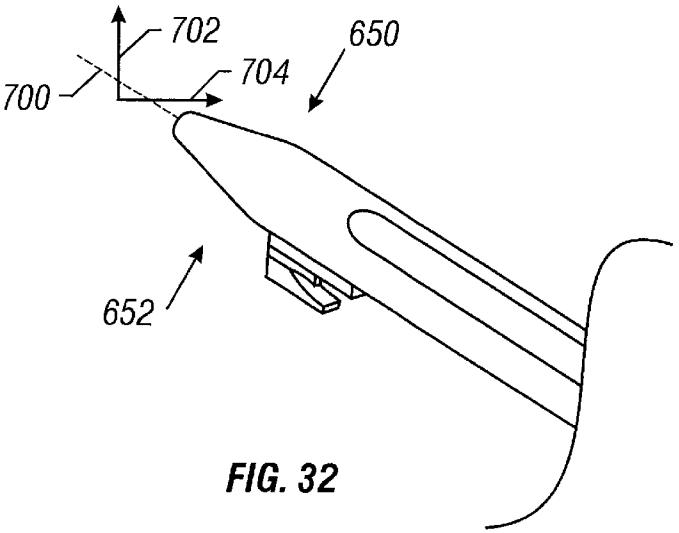

FIG. 6 is a sectional view taken along line 6—6 of the deflection tool of FIG. 3 showing the geometry of the pilot mill guide bearing of the deflection tool before milling has taken place, showing a pilot mill located within the pilot mill guide bearing and further showing fastener means releasably securing the pilot mill within the pilot mill guide bearing for installation of the window milling assembly;

FIG. 7 is a sectional view taken along line 6—6 of the deflection tool of FIG. 3 showing the geometry of the pilot mill guide bearing of the deflection tool after casing window milling has taken place and showing the resulting open guiding face that is formed by staged milling of the pilot mill guide bearing by staged milling;

FIGS. 8–10 are longitudinal sectional views in sequence, showing an accurate casing exit operation being carried out according to the teachings of the present invention;

FIG. 11 is a longitudinal sectional view showing the pilot mill sub-assembly of the present invention;

FIG. 12 is a transverse sectional view taken along line 12—12 of FIG. 11;

FIG. 13 is an end view of the pilot mill sub-assembly of FIGS. 11 and 12 and showing the milling end face of the pilot mill;

FIG. 14 is a sectional view showing an alternative embodiment of the present invention located within a well casing at the position for initiating casing window milling and wherein the rotary drive motor and the stabilizer are adapted to be guided within the guide passage of the deflecting tool along with the pilot mill for predictable milling of a casing window and showing deflecting tool geometry for retrieval thereof following casing window milling;

FIG. 15 is a sectional view similar to that of FIG. 14 and showing the casing window milling operation in progress, with the pilot mill nearing completion of window milling and with the string mills having removed a sacrificial portion of the deflecting tool to define a predictable guide configuration for subsequent guiding of well tools into the lateral bore;

FIG. 16 is a sectional view showing the deflecting tool of FIGS. 14 and 15;

FIG. 17 is a sectional view taken along line 17—17 of FIG. 16;

FIG. 18 is a sectional view taken along line 18—18 of FIG. 16;

FIG. 19 is a sectional view taken along line 19—19 of FIG. 16;

FIG. 20 is a partial longitudinal sectional view showing a casing window milling system representing an alternative embodiment of the casing window milling system of present invention having a pilot mill adapted for controllable articulation relative to the milling shaft and showing the pilot mill in a condition for articulating relationship with the milling shaft to permit guiding of the pilot mill by the inclined guide surface of the deflecting tool;

FIG. 21 is a partial longitudinal sectional view similar to FIG. 20 and showing the pilot mill of FIG. 20 being maintained with its longitudinal axis in coaxial relation with the longitudinal axis of the substantially rigid milling shaft to permit guiding control of the pilot mill at least in part by the milling shaft;

FIG. 22 is a sectional view showing an alternative embodiment of the deflection tool and further showing the pilot mill of the milling tool being located within a substantially tubular guide bearing of the deflection tool;

FIG. 23 is a sectional view showing an example of a window milled in the casing using the alternative embodiment shown in FIG. 22;

FIG. 24 is a partial sectional view of the pilot mill including one embodiment of the core breaking mechanism;

FIG. 25 is a partial sectional view of the pilot mill including a second embodiment of the core breaking mechanism;

FIG. 26 is a front view of the pilot mill including the second embodiment of the core breaking mechanism;

FIG. 27 is a partial sectional view of the pilot mill secured to the deflecting tool with one embodiment of the first retaining mechanism, second retaining mechanism, and protection mechanism;

FIG. 28 is a partial sectional view of the pilot mill secured to the deflecting tool with a second embodiment of the first retaining mechanism and protection mechanism;

FIG. 29 is a partial sectional view of the pilot mill secured to the deflecting tool with a third embodiment of the second retaining mechanism;

FIG. 30 is a sectional view of the retrieving tool inserted in the deflecting tool;

FIG. 31 is a view taken along line 31—31 of FIG. 30;

FIG. 32 is an isometric view of the retrieving tool; and

Figure 33:
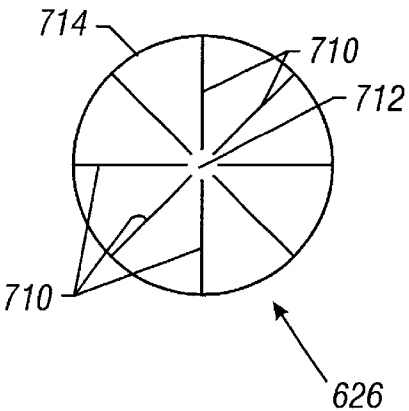

FIG. 33 is a front view of one embodiment of the resilient member.

DETAILED DESCRIPTION OF THE INVENTION

Figure 1:
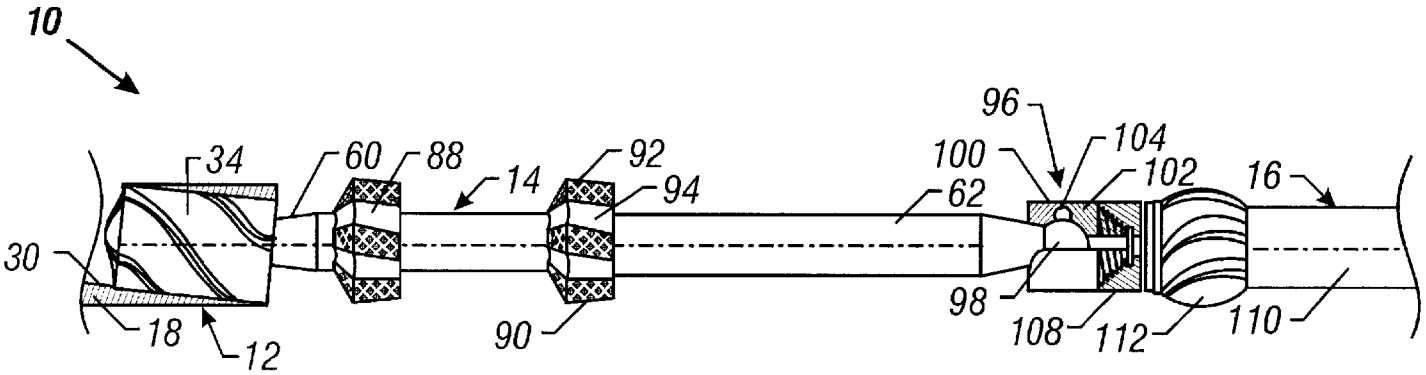
Figure 2:
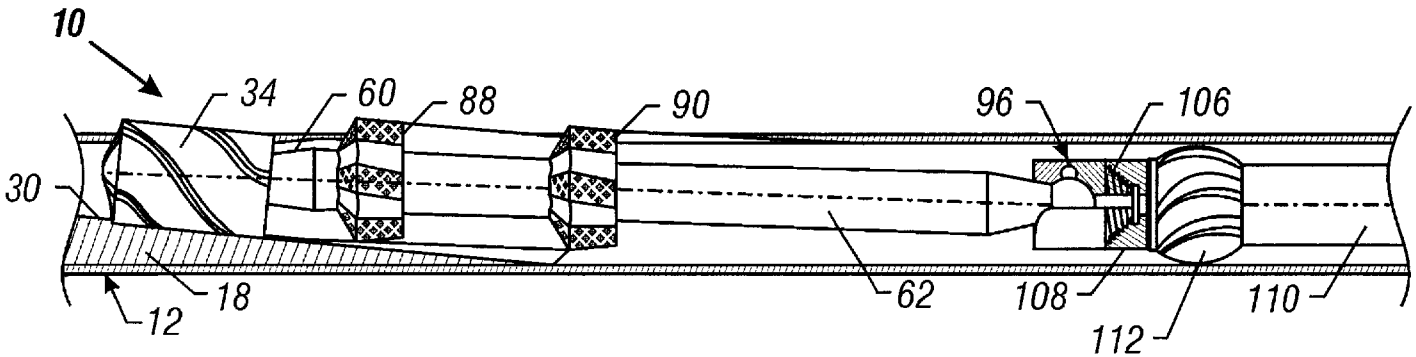

Referring now to the drawings and first to FIGS. 1 and 2, a downhole casing window milling assembly constructed in accordance with the principles of the present invention and representing the preferred embodiment of the present invention is shown generally at 10. The casing window milling assembly 10 is comprised of deflecting tool shown generally at 12, and a milling tool shown generally at 14 and rotary drive motor assembly shown generally at 16.

The deflecting tool 10 is defined by an elongate deflecting body 18 which is adapted to be run into the main well casing and to be precisely located and oriented for milling of a casing window. The deflecting tool 18 may define a longitudinal passage 20 through which fluid may be caused to flow and through which certain downhole well operations may be conducted. The longitudinal passage 20 will not interfere with deflection of the window milling system during milling operations because, as will be explained in detail hereinbelow, the window milling string of the milling tool will be caused to precisely traverse a predetermined trajectory to ensure generation of a guide surface of predetermined configuration on the deflecting body as the milling tool is deflected from the longitudinal axis of the well casing and progresses along a predetermined inclined path through the wall of the well casing. The longitudinal passage 20 will also accommodate a suitably sized spear fishing tool without compromising the guiding and performance of the deflecting tool. This feature enables simple and efficient removal of the deflecting tool from the well casing. The longitudinal passage 20, if desired, may be initially filled with a drillable material which is easily removed with the deflecting tool set within the well casing in the event the fluid flow or retrievable characteristics of the deflecting tool are needed. The deflecting tool 12 may also define a connection geometry to provide efficiently for connection thereof to a retrieval device that is run into the well casing for connection to and retrieval of the deflecting tool 12 subsequent to the window milling operation.

At its lower or forward end the elongate deflecting body 18 defines a connector shown generally at 22 which enables connection of various other well equipment such as an anchor, bridge plug, selective landing tool or other means that positively secure the deflection tool in the well casing. The connector 22 may take the form of a connection receptacle 24 into which a connecting section of other well equipment is received. Connection may be established by a releasable connector element 26 or by any other suitable means. Orientation of the deflecting tool 12 with respect to the well casing may be established in any suitable manner. For example, the well casing may be provided with an orienting coupling within which is located an orienting slot or an orienting key of conventional nature. The deflecting tool or any other apparatus to which the deflecting tool is connected may be provided with a corresponding orienting feature for orienting engagement with the orienting slot or key to thus provide for precise location and orientation of the deflecting tool with respect to the well casing. In the alternative, for well casings without indexing or orienting features, an indexing packer may be set in suitably located and oriented relation within a well casing and the diverting tool may be landed and set with respect to the orienting and indexing feature of the indexing packer.

At its upper or trailing end the deflecting tool 12 is provided with a pilot mill guide which defines a contoured and inclined guide surface 30 representing the primary inclined guide surface of the deflecting tool. As is evident from the transverse sectional view of FIG. 6, taken along line 6—6 of FIG. 3, the contoured inclined guide surface 30 may initially be of partially cylindrical or curved cross-sectional configuration so that it defines an elongate inclined guide groove or slot which diverts a forwardly moving milling assembly from the longitudinal axis of the main well bore to the desired exit angle for a lateral bore.

Conventionally, when the initial milling element of a casing window milling assembly comes into contact with a deflecting tool, also identified as a whip-stock, significant lateral force is imparted both to the whip-stock and to the initial milling element. This typically results in significant removal of material forming the guide surface of the whip-stock and results in significant application of bending or deflecting force to the milling tool and its rotary drive mechanism. Since most conventional casing window milling tools are diverted but not significantly guided, the milling tool will tend to wander during window milling so that the casing window formed by the milling operation is typically imprecise from the standpoint of location, orientation, window size and contour geometry. To overcome this disadvantage it is considered desirable to ensure precision guiding and controlled orientation of the milling assembly especially during initial milling contact with the well casing. According to the principles of the present invention this precision milling tool guiding feature is accomplished by providing the deflecting tool with a guiding and stabilizing feature for ensuring the accuracy of milling tool tracking during milling. The precision milling feature is also enhanced by eliminating or significantly minimizing application of lateral forces to the deflecting tool and to the milling assembly. To ensure the accuracy of orientation, location, dimension of the contour geometry of the casing window being milled it is necessary to establish precision guiding and stabilization of the initial milling element at the outset of the milling operation. To accomplish this initial guiding and stabilization feature the elongate body 18 of the deflecting tool 12 is defined in part by a guide bearing 32 of generally tubular geometry which defines a generally cylindrical internal guide surface 33 which may form a part of the inclined guide surface or face 30. Thus the inclined contoured guide surface 30 is in part of cylindrical configuration so as to define a pilot mill guide surface that is oriented along a predetermined inclination relative to the longitudinal axis of the well casing that establishes a predetermined lateral bore trajectory to be followed by milling apparatus for milling a casing window of predictable dimension and contour geometry and to establish the trajectory of a lateral wellbore which is subsequently drilled along the trajectory that is established by window milling equipment.

The milling tool shown generally at 14 incorporates a pilot mill 34 which has a substantially cylindrical outer guided periphery 36 defined by a plurality of lands 38 that are separated by fluid transfer channels 40. The lands 38 are defined by cylindrical surface segments which establish non-milling guided relation with the internal cylindrical surface 30 of the guide bearing 32 and after moving past the guide bearing, establish non-milling guided relation with the inclined contoured guiding face 30 of the deflecting tool. The internal cylindrical guide surface 33 of the guide bearing 32 ensures that the pilot mill is precisely confined to its intended trajectory and ensures precision milling of a pilot bore through the well casing and into the formation surrounding the casing. Since only the non-milling cylindrical guided surface of the pilot mill 34 will contact the internal cylindrical surface 33 of the guide bearing 32 or the inclined guide surface 30, the inclined contoured guide surface will not be eroded to any significant extent by the pilot mill 34 and thus will remain after completion of the milling operation has been completed to serve as a guide surface for guiding other well tools through the casing window and into the lateral bore.

As the pilot mill 34 is diverted from the longitudinal axis of the main well casing to the trajectory of the branch bore it is desirable that no significant lateral forces be imparted either to the pilot mill 34 or to the diverting tool 12. It is also desirable that the pilot mill 34 have an efficiently guided and stabilized relationship with the internal cylindrical guiding surface of the guide bearing 32 as milling of the casing is initiated. It is considered desirable therefore to provide the pilot mill 34 with pivotally articulated connection with a relative to a substantially rigid milling shaft, to be discussed in detail hereinbelow, and to locate its point of pivotal articulation internally and intermediate the length of the pilot mill. This feature will enable the pilot mill 34 to be readily pivoted so that it will precisely track the angular inclination defined by the internal generally cylindrical surface 33 of the guide bearing 32.

Referring now particularly to FIGS. 11 and 12 the pilot mill 34 has a mill head structure 35 from which extends an elongate generally cylindrical mill body 37. The mill body 37 defines an internal connection receptacle 42 within which is seated a pair of universal joint inserts 44 and 46 being secured in fixed relation within the connection receptacle 42 of the pilot mill structure by connection pins 48 and 50 which are welded as shown or otherwise fixed to the pilot mill structure. The connection pins 48 and 50 are received within connection pin receptacles that are defined respectively within the universal joint inserts 44 and 46 as shown in FIG. 11. It is to be borne in mind that the universal joint inserts may be fixed within the connection receptacle 42 by any other suitable means, such as by welding or by machining partially spherical surface segments within the mill body 37. The universal joint inserts 44 and 46 further define internal spherical surface segments 52 and 54 which, when the inserts are positioned in assembly as shown in FIG. 11, cooperatively define a spherical receptacle 56 within which is retained a spherical universal joint element 58 defining a part of the forward end 60 of an elongate tubular milling shaft 62.

To maintain a non-rotatable relationship and to provide for torque transmission between the milling shaft 62 and the pilot mill 34 and to also permit articulation of the pilot mill relative to the elongate milling shaft the universal joint receptacles 44 and 46 also define ball receptacle segments 64 and 66 respectively. The ball receptacle segments 64 and 66 cooperate with a plurality of ball receptacle segments 68 to define a plurality of ball receptacles 70 each receiving a torque transmitting ball 72. The ball receptacles 70 are of greater dimension than the dimension of the torque transmitting balls as shown in Fig. 11 to thereby permit the pilot mill 34 to have the capability for pivotal articulation relative to the milling shaft 62. The looseness of fit of the torque transmitting balls 72 with their respective ball receptacles permits movement of the pilot mill 34 about a point P located on the longitudinal axis 74 of the elongate milling shaft. This feature permits the pilot mill to maintain a predetermined inclination with respect to the longitudinal axis of the milling shaft 62 as the pilot mill is rotated by the milling shaft. This feature also permits efficient guiding of the pilot mill by the inclined guiding features of the diverting tool without imparting significant lateral force to the diverting tool or bending moment to the substantially rigid milling shaft 62.

The head structure 35 of the pilot mill 34 also defines a circular tapered milling face 76 which intersects with a flat, circular, centrally located mill nose 78. The milling face and mill nose is provided with any suitable means for milling or eroding the well casing to define a pilot window opening therein. It should be borne in mind that the cylindrical outer periphery 36 of the pilot mill 34 is not provided with milling or cutting elements or materials so that milling of the well casing occurs only when the end face 76 of the pilot mill 34 is moved into contact with the well casing as the pilot mill is rotated by the milling shaft 62 via the universal joint interconnecting the pilot mill 34 with the milling shaft. The end face and mill nose of the pilot mill 34 is coated with adequate abrasive inserts such as tungsten carbide compound or other suitable abrasive materials that are utilized on casing window mills. The abrasive milling material may be brazed or otherwise fixed to the face surface of the pilot mill and to the surfaces of string mills that follow the pilot mill. Thus, the pilot mill 34 is capable of milling only when its end face 76 is in contact with the well casing. Contact by the outer peripheral surface 36 of the pilot mill with the well casing, the deflecting tool or any other structural object will not cause erosive wear thereof. The outer cylindrical surface 36 of the pilot mill 34 is intended only for guide purposes to guide the pilot mill along an intended inclined trajectory with respect to the longitudinal axis of the well casing so as to perform a pilot opening in the well casing.

To enhance milling of the well casing by the pilot mill 34, the pilot mill defines a plurality of fluid circulation passages 80 which are disposed in communication with a circulation fluid supply manifold passage 82. The manifold passage 82 receives circulation fluid from a fluid supply passage 84 of the elongate tubular milling shaft 62. Thus, the universal joint additionally serves for fluid flow transmission between the tubular milling shaft and the pilot mill 34. The milling end face 76 of the pilot mill 34 also defines fluid circulation channels 86 which transport the circulation fluid medium from the circulation passages 80 to the side channels 40 of the pilot mill. Although the lands 38 and the side channels 40 of the pilot mill are shown to be of helical configuration in FIG. 3 to enhance circulation flow as the pilot mill is rotated, it should be borne in mind that the lands and side channels may be of any other configuration, such as substantially straight and parallel, without departing from the spirit and scope of the present invention. To ensure against fouling of the universal joint by debris such as particulate milled from the well casing or from the surrounding formation the internal connection receptacle 42 may be provided with a seal assembly 43, such as a bellows seal for example, for excluding any such debris from the universal joint. In addition to providing a seal between the pilot mill 34 and the milling shaft 62, the seal 43 must also accommodate the pivotal articulation of the pilot mill relative to the milling shaft.

Referring now again to FIGS. I and 2 the elongate tubular milling shaft 62 is substantially rigid and is provided with at least one milling element 88 and preferably a plurality of string milling elements or mills 88 and 90 which are fixed in spaced relation along the length of the milling shaft. Although two milling elements 88 and 90 are shown it should be borne in mind that any number of milling elements may be located along the length of the milling shaft 62. The initial string mill is located quite close to the pilot mill so that most of the window opening that is milled within the well casing is formed by the initial string mill. The mill 88, or the first of the string mills 88 and 90, will typically have a diameter exceeding the diameter of the pilot mill 34. In this case the first string mill 88 will be a gauging mill which greatly enlarges the much smaller pilot mill bore to roughly the desired diameter necessary for a casing window of predetermined dimension and contour geometry. The second of the string mills, mill 90, will typically be a reaming mill which finalizes the dimension and contour geometry of the window being milled in the well casing. The diameter of the string mills is typically very close to the drift diameter of the well casing. The string mills 88 and 90 each define a plurality of abrasive covered lands 92 and fluid circulation channels 94 to provide for milling of the well casing and to permit fluid circulation past the string mills during milling activities. If desired, the fluid circulation channels of the string mills may be provided with a flow of fluid from the internal passage 84 of the milling shaft 62 to thus provide for cooling of the string mills and for removal of milled particulate and other debris as a window milling operation is in progress.

In the case of undersized casing windows, meaning that the diameter of a cylinder passing through the window is substantially smaller than the casing inside diameter, the diameter of the pilot mill 34 and the string mills 88 and 90 may be of equal diameter. This is generally the case of a window milling operation in a production liner/casing having the requirement that the milling tool must pass through a production tubing string.

As the casing window milling operation progresses the orientation of the milling shaft 62 will be translated from a coaxial relation to an inclined relation with the longitudinal axis of the main wellbore as shown by angle "d" in FIG. 8. It is desirable that the rotary drive means of the casing milling system be isolated or decoupled from any lateral forces or bending moments that might cause exceptional wear of the bearings of the rotary drive mechanism. At its trailing or upper end the elongate tubular milling shaft 62 is provided with an articulating connection shown generally at 96. This articulating connection may be of substantially identical construction and function, as compared to the universal joint mechanism of FIG. 11, which establishes articulating connection of the pilot mill 34 to the forward end 60 of the milling shaft 62. The articulating connection 96 is established by a spherical end 98 of the milling shaft which is captured by universal joint inserts 100 and 102 in the same manner as discussed above in connection with the universal joint of FIG. 11.

Driving rotation between the universal joint 96 and the elongate milling shaft 62 is defined by a plurality of torque transmitting ball elements 104 which are loosely received within ball receptacles in the same manner and for the same purpose as described above. The universal joint connection 96 also defines a flow passage such as shown at 84 in FIG. 11 to permit the flow of circulation fluid into the milling shaft passage 84 from the drill string to which the rotary drive mechanism is connected. The universal joint connection at the forward end of the milling shaft 62 with the pilot mill 34 and the universal joint connection 96 at the trailing end of the milling shaft permits orientation of the milling shaft at any point in time to be established jointly by its forward and trailing universal joint connections. Moreover, the elongate tubular milling shaft 62 is substantially rigid and is decoupled from both the pilot mill and the rotary drive mechanism by its universal joint connections so that it is not deflected significantly by any of the forces to which it is subjected during milling operations. The rigidity of the milling shaft causes the string mills 88 and 90 to be efficiently guided by the pilot mill as the pilot mill 34 is guided along its intended trajectory by the inclined guide surface 30 of the body structure 18 of the deflecting tool 12. Since the milling shaft is oriented by the positions of its universal joints, the string mills do not remain concentric with the pilot mill or with the universal joint connection thereof with the rotary drive mechanism. This feature causes the string mills to have controlled milling relation with the primary inclined guiding feature 30 of the body structure 18 of the deflecting tool 12 as shown by FIG. 2 and as shown in the operational views of FIGS. 9 and 10. Thus, the string mills change a portion of the primary inclined guide surface during milling so that a predetermined contoured guide surface will remain after completion of the window milling operation to serve as a contoured guiding face for well equipment that is run into the well casing and diverted through the casing window and into the lateral bore.

For rotation of the milling shaft 62 the universal joint 96 for driving and permitting articulation of the milling shaft is provided with a threaded pin type pipe connection 106 which is received by the internally threaded box connection 108 of the rotary output shaft of the rotary drive assembly 16. The rotary drive assembly 16 incorporates a rotary drive motor 110 which is positioned by a drill string extended from the surface through the well casing. It should be borne in mind that rotary drive motor 110 may take any number of suitable forms without departing from the spirit and scope of the present invention. For example, the rotary drive motor may conveniently take the form of a rotary positive displacement motor or a turbine which is driven by the flow of a fluid medium being pumped through the drill string to the rotary motor. The rotary drive motor 110 may also be powered by a mud motor that is connected at the lower end of a drill string extending from the surface. The drill string may be fixed during window milling operations or in the alternative, it may be rotated at a suitable rotary speed to provide for operation of the casing window milling assembly. Additionally, a rotary drill string may be utilized in combination with a rotary positive displacement motor, turbine or the like for achieving desired rotary speed and torque of the elongate milling shaft to provide for optimum window milling.

It is well known that rotary apparatus such as a fluid energized motor, rotary drill string etc. are rotated within a well casing, the rotary apparatus tends to oscillate or otherwise become unstable within the well casing. To ensure that no extraneous oscillation is transmitted to the milling tool 14 by the rotary drive motor, a stabilizer 112 is connected between the drive motor 110 and the connection box 108. Thus, as it is rotatably driven the upper or trailing end of the elongate tubular milling shaft 62 is stabilized by the stabilizer element 112 and thus remains essentially free of vibration which might otherwise contribute to inaccuracy of casing window milling. As is typical with stabilizers, the stabilizer 112 is provided with lands and fluid circulation channels as shown.

Referring now again to FIGS. 3, 6, and 7 the casing window milling assembly 10 may be inserted into the well casing as a unitary or integrated assembly. This is accomplished by positioning releasable fasteners such as shear screws 113 and 114 in the tubular guide bearing 28 so as to resist both rotary and linear motion of the pilot mill 34 and the milling shaft 62 relative to the deflecting tool 12. The shear strength of the shear screws 113 and 114 is sufficient to maintain the fixed relation of the pilot mill 34 within the tubular bearing 32 and to support the deflecting tool 12 as the casing window milling assembly 10 is inserted into and set with respect to the well casing. This feature permits both the deflecting tool 12 and the milling tool 14 to be properly positioned within the well casing in a single pass running operation. After the deflecting tool 12 has been properly oriented and set within the well casing, with the milling assembly fixed thereto by fastening means, milling operations may be initiated by applying sufficient rotational force to the pilot mill 34 by the milling shaft 62 to cause shearing of the shear screws 113 and 114. After this has been accomplished the pilot mill 34 is then free of the tubular bearing and may be rotated and moved linearly toward the well casing wall as it is guided initially by the internal cylindrical surface of the guide bearing 32 and then by the inclined contoured guide surface 30 of the elongate deflecting tool body 18 of the deflecting tool 12. This feature enables the pilot mill 34 to form a pilot bore along the intended inclined trajectory established by the tubular bearing 32 and the inclined guide surface 30 and to cause precision milling of a pilot window in the well casing and a precisely oriented and located pilot bore into the immediately surrounding structure, i.e. casing cement and formation material as is evident from FIGS. 2, 9 and 10.

OPERATION

Preferably the deflecting tool and the milling tool are run into the well casing as an integral unit, so that casing window milling can be initiated by a single pass installation. In this case the shear screws 113 and 114 will maintain the milling tool in releasable assembly with the deflecting and will maintain the pilot mill 34 secured within the pilot mill bearing 28 essentially as shown in FIGS. 3 and 6. To release the pilot mill for milling rotation a suitable force is applied either by rotating the milling shaft and pilot mill with the rotary power source 110 or by imparting a linear force to the milling shaft. After the casing window milling assembly 10 has been located within the well casing with the deflecting tool being oriented and fixed within the well casing and the pilot mill 34 rendered rotatable as the result of shearing the shear screws 113 and 114 or otherwise releasing suitable fastener means, the elongate milling shaft 62 is rotatably driven by the rotary drive means 110 and linear movement of the milling tool 14 is initiated. As the pilot mill 34 is rotated and moved linearly during the initial stage of casing window milling it is rendered highly stable by the tubular guide bearing section of the deflecting tool 12. Since the pilot mill 34 is of essentially cylindrical configuration and is initially rotated within the substantially cylindrical internal surface of the guide bearing 32 it is simply and efficiently self guided and stabilized by the tubular guide bearing 32 and precisely oriented for milling a pilot opening of accurately controlled location, orientation and contour geometry in the well casing. This self guiding and stabilizing feature of the pilot mill 34 is enabled by locating the articulation pivot point of the pilot mill internally thereof and intermediate its axial length and along its axis of rotation. Stabilization of the pilot mill 34 in this manner enables the pilot mill to initiate window milling of the well casing and to generate a precisely controlled pilot bore which provides for guiding milling shaft 62 and its gauging and reaming mills 88 and 90. As mentioned above, the articulating connection of the pilot mill with the forward end of the milling shaft and the articulated connection of the trailing end of the milling shaft with the bit box connection of the rotary drive means and stabilizer assembly results in stabilized rotation and orientation as well as precision guiding of the milling shaft 62 at both of its ends. Since the milling shaft 62 is substantially rigid, this double ended articulation of the milling shaft causes its progressive orientation as the pilot mill 34 continues milling a pilot bore of inclined trajectory through the well casing and into the surrounding formation, with orientation of the pilot bore being determined by the inclination of the internal cylindrical guide surface guide surface 30 of the deflecting tool 12. Immediately as the forward end of the pilot mill 34 is projected from the tubular guiding and stabilizing surface of the tubular guide bearing 32 the inclined trajectory of the pilot mill 34 and its articulating connection with the forward end of the milling shaft 62 will cause the milling end face 76 of the pilot mill to engage and begin milling a pilot window opening in the well casing. Simultaneously, as shown particularly in FIG. 2 the inclined trajectory of the pilot mill 34, through its articulated connection with the milling shaft 62 causes the gauging and reaming milling elements 88 and 90 to be maintained in controlled relation with the inclined guide surface of the deflecting tool. This causes the string mills 88 and 90 to enlarge and finalize the pilot window in the well casing and to establish the initial inclination of an inclined lateral bore while at the same time having controlled guide surface forming relation with the elongate body 18 of the deflecting tool 12. It should also be noted that the guided relation of the pilot mill 34 with the tubular bearing structure 32 and the inclined contoured guide face 30 causes the string mills 88 and 90 to be directed into milling contact with a sacrificial portion 41 of the tubular bearing structure 32 which is shown in FIG. 6 and is shown to have been removed in FIG. 7. When the pilot mill 34 is located within the tubular guide bearing 32 the appearance of the tubular guide bearing will be as shown in FIG. 6. After the milling operation has been completed the string mills 88 and 90 will have milled away a sacrificial portion of the tubular guide bearing 32, leaving an open guiding face 116 that is defined by curved lateral segments 118 and 120 having an intermediate curved guide surface segment 122 which is located between the curved guide surface segments 118 and 120 and which is defined by the original cylindrical configuration of the internal guide bearing surface 30. After the milling operation has been completed the open guiding face 116 will serve as a deflecting guide surface for guiding various well tools into the lateral branch.

Figure 5:
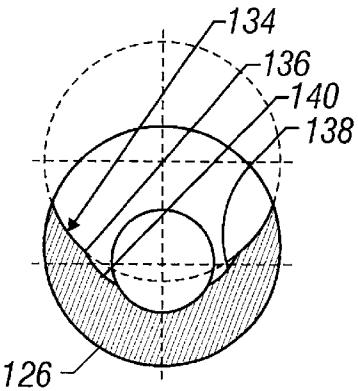
Figure 4:
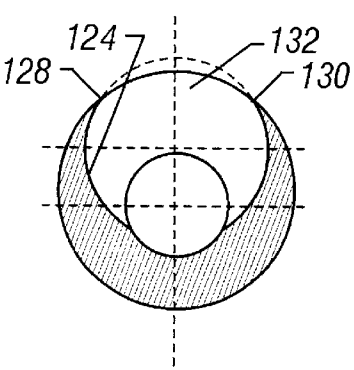

As shown by the transverse sectional views of FIGS. 4 and 5, both taken along line 4—4 of FIG. 3, the transverse geometry of the deflecting tool body 18 will have the configuration shown in FIG. 4 before the casing window has been milled. In the region of he section line 4—4 the deflecting body 18 will define an open guiding face 124 which is defined by a substantially cylindrical guiding surface which intersects the flow passage 20 and also intersects the outer peripheral surface 126 of the deflecting tool at 128 and 130 and thus defines an open guide face or slot 132. After the milling operation has been completed the sacrificial region 41 of the tubular guide bearing 32 and the deflecting body 18 will have been removed, leaving an open contoured guiding face 134. The contoured open guiding face 134 is defined in part by guide surface segments 136 and 138 which form a part of the undisturbed pilot guide surface 30. The path of the string mills 88 and 90 will have been controlled by the inclined trajectory of the pilot mill 34 so that a central guide surface segment 140 will not have been contacted or will have been contacted in controlled manner by the string mills and will thus remain either at its original geometry or a predetermined geometry. After the casing window milling operation has been completed other well tools, such as those for drilling, lining, cementing and completing and otherwise constructing the lateral branch, will be guided by the original guide surface segment 140 of the guide surface 30 through the casing window and into the lateral branch.

It is considered within the scope of the present invention to provide for guiding of the pilot mill during its initial milling by a generally tubular guide section of the deflecting tool as discussed above in connection with FIGS. 1–13, as shown in FIGS. 14–19, and to also provide for guiding of the rotary motor and stabilizer within the deflecting tool rather than in the well casing. This feature can enable the milling tool to be of more compact design as compared with convention milling tool design and can enable the milling system to accomplish milling of a casing window and tool guide surface of predictable dimension and configuration. It is also considered within the spirit and scope of the present invention to provide the deflecting tool with a specific geometry enabling the deflecting tool and the milling tool to be run into the well casing as a unit and enabling the deflecting tool and the milling tool to be extracted from the well casing as a unit when a window milling operation has been completed.

Referring now to FIGS. 14–19, an alternative embodiment of the present invention is shown generally at 150 which accomplishes the above features. Within the well casing 152 is set a deflecting tool 154 which is located and oriented in any suitable manner as discussed above. The deflecting tool 154 defines an elongate generally tubular section 156 defining an internal guide surface or passage 158 of generally circular cross-section which is of inclined and slightly curved configuration and which intersects the outer periphery 160 of the deflecting tool an a manner defining a lateral guide opening 162. The lateral guide opening 162, the deflecting tool 154 defines a generally tubular pilot guide section 166 which is slightly offset with respect to the internal guide surface 158 and defines a generally cylindrical internal pilot guide surface 168 within which the pilot mill 34 is located at the beginning of window milling as shown in FIG. 14 to insure proper location of the milling tool 14 when window milling is initiated, thus insuring that the pilot mill 34 is precisely oriented by the internal generally cylindrical guide surface 168 the deflecting tool 154 defines an end flange 170 defining a transverse shoulder 173 and forming a guide opening 174. When casing window milling is initiated, a trailing shoulder 177 of a rotary drive motor 110 is normally in engagement with the transverse shoulder 173. This feature permits the deflecting tool 154 to be supported by the milling tool system 14 as the deflecting tool and milling tool are run into the casing as a unit. Alternatively, and as described above, the pilot mill 34 may be temporarily secured within the pilot mill guide surface 168 by shear screws as described above or by any other suitable means for retention and release. The internal opening 174 of the end flange 170 to pass through the end flange as window milling operations progress, as shown in FIG. 15. The end flange 170 also facilitates extraction of the milling tool and the deflecting tool as a unit when milling operations have been completed. As the drill stem 180 is withdrawn upon completion of casing window milling the end shoulder 176 of the rotary drive motor 178 will eventually come into contact with the transverse shoulder 173 of the deflecting tool 154. Thereafter, further extracting movement of the drill stem 180 will also accomplish extraction of the deflecting tool 154. It should also be born in mind that the deflecting tool 154, if intended to remain within the well casing as a subsequent guide for well tools from the main well bore into the lateral bore, the end flange 170 may be eliminated. In this case the deflecting tool 154 will be designed with a "pulling geometry" which will enable its subsequent extraction from the well casing to be accomplished by any suitable pulling equipment. Since the resulting guiding geometry of the deflecting tool 154 will be predictable, the pulling geometry of the deflecting tool is also precisely controlled.

The cross-sectional geometry of the deflecting tool 154 is rendered more evident from FIGS. 17, 18 and 19. As shown in FIG. 17, the internal cylindrical surface 168 is inclined to establish the desired inclination of the pilot bore that is milled by the pilot mill and has an internal diameter shown at 182 within which the outer diameter of the pilot mill 34 is closely fitted. It should be born in mind that the pilot mill 34 is oriented by the internal pilot mill guide surface 168 only at the initial stage of casing window milling. After the trailing end of the pilot mill has cleared the internal cylindrical guide surface 168, the pilot mill will maintain its angulated orientation relative to the main well bore by that portion of the guide surface of the deflecting tool which is located forwardly of the pilot mill guide surface 168. Also, since the pilot mill 34 is of cylindrical configuration and is provided with a milling surface only at its leading end, the cylindrical outer periphery of the pilot mill will maintain the orientation that has been pre-established by the pilot mill guide surface 168.

The cross-sectional illustration of FIG. 18 shows a partially tubular internal guide surface being an extension of the internal guide surface 158 of the deflecting tool and having an internal diameter 184 greater than the internal diameter 182 of the guide surface 168 shown in FIG. 17. This greater internal diameter is sufficient to establish guiding relation with the rotary drive motor and/or the stabilizer element 112 which is connected to the rotary drive motor 110.

As shown in the sectional view of FIG. 19, the end flange 170 of the deflecting tool 154 is defined by opposed flange sections 171 and 172.

As mentioned above, casing milling is initiated with the milling tool 14 shown positioned as in FIG. 14 with the pilot mill 34 disposed in guided relation with the internal cylindrical guide surface 168. As the milling tool 14 is moved forwardly by movement of the drill stem 180 the drill stem will be guided by the cylindrical surface sections of the flange sections 171 and 172 that define the end flange 170. As this movement occurs the first string mill 88, which may also be referred to as a gaging mill, begins to remove the pilot mill guide section 166 of the deflecting tool. After the second or reaming mill 90 of the elongate milling shaft 110 has passed through the pilot mill guide section of the deflecting tool, the upper portion of the pilot mill guide section will have been removed, leaving a guide passage essentially being an extension of the internal guide surface 158 of the deflecting tool 154. Consequently as the rotary drive motor 110 and its stabilizer 112 are moved along the internal guide surface 158 efficient positioning of the rigid milling shaft 162 will be maintained thus causing its string mills 88 and 90 to continue milling an inclined, slightly curved guide passage along the intended trajectory that is desired for the lateral bore. Thus, the rigid milling shaft, being pivotally connected to the pilot mill 34 and to the rotary drive motor 110 will be precisely controlled as it follows its intended milling trajectory. The deflecting tool 154 will be milled in controlled fashion to effectively form the inclined guide surface 158. The result is that the casing window is milled to precision location, orientation and geometry during casing window milling. Additionally, the dimension of the bore that is milled by the milling tool will be closely controlled so that wandering of the milling tool is minimized during the milling operation. The net result is predictable and controlled window milling which insures that the deflecting tool achieves a predictable configuration as the result of the milling operation so that it can function efficiently as a tool guide and can be efficiently extracted from the well casing when its use is no longer needed.

Referring now to FIGS. 20 and 21 a further alternative embodiment of the casing window milling system of the present invention is shown in longitudinal section generally at 190. As mentioned above, it is desirable that the pilot mill, when casing window milling is initiated, be freely pivotal for articulation or angular misalignment relative to the longitudinal axis of the milling shaft to permit efficient guiding of the pilot mill along the inclined guide surface of the deflecting tool. After the pilot mill has moved free of the tubular guide bearing of the deflecting tool and has moved along the inclined guide surface of the deflector to an extent that self guiding of the pilot mill can no longer be assured, it is desirable to control the articulating mechanism of the pilot mill and milling shaft rotary drive connection so that the degree of articulation is limited or minimized to permit the trajectory of the pilot mill to be controlled jointly by the deflecting tool and the milling shaft. This feature prevents unconsolidated formations from permitting or causing the pilot mill to be diverted from its intended trajectory.

The embodiment of FIGS. 20 and 21 illustrate the articulating connection between a pilot mill shown generally at 192 and a substantially rigid milling shaft shown generally at 194, wherein the pilot mill is enabled for substantially free articulation relative to the milling shaft when in the condition shown in FIG. 20 and is maintained in substantially coaxial relation with the milling shaft when in the condition shown in FIG. 21. The pilot mill 192 has a generally circular pilot head 196 to which is fixed or secured a generally cylindrical stabilizing sleeve 198 which defines external grooves 200 and lands 202 to permit the flow of fluid externally of the pilot mill for purposes of cooling and for removal of mill cuttings and other debris. The pilot head 196 defines a milling face 204 and also defines one or more fluid distribution passages 206 through which milling fluid is conducted from an internal fluid chamber 208 to the milling face 204. Although the milling face 204 is shown to be of planar configuration in FIGS. 20 and 21 it should be born in mind that it may be of tapered configuration, essentially as shown at 76 in FIG. 11 or it may be rounded or of any other suitable milling face configuration. The outer peripheral lands 202 of the generally cylindrical stabilizing sleeve 198 served to stabilize rotation of the pilot mill as it is rotatably driven by the generally rigid milling shaft 194. This feature enables the pilot mill to be efficiently guided by the inclined guide face 210 of a deflection body 212 that is set within the well casing. Preferably the deflecting body 212 is of the configuration and function shown at 18 in FIGS. 1, 2, and 3 and described in detail above.

The generally cylindrical stabilizing sleeve 198 is of tubular configuration and defines a generally cylindrical internal chamber which is formed by internal cylindrical surface segments 214 and 216. The cylindrical surface segment 214 is of slightly larger diameter as compared with cylindrical surface segment 216 and at the juncture of these surface segments is defined an internal circular shoulder 218. A tubular bushing support housing 220 is fixed within the cylindrical surface segment 214 of the internal chamber of the pilot mill 192 with a circular shoulder 222 thereof being located in abutment with the internal circular shoulder 218 of the stabilizing sleeve 198. The pilot head 196 and the bushing support housing 220 define the internal chamber 208. The bushing support housing 220 provides for location of articulation bushings 224 and 226 which cooperatively define a generally spherical internal chamber 228 which receives a spherical end member 230 of the milling shaft 194, thus permitting articulation of the milling shaft in pivotal relation about a pivot point "P" and within an authorized angle of mis-alignment shown by angle "A" relative to the axial center-line "C" of the milling shaft 194.

The milling shaft 194 defines an end section 232 which tapers from a milling shaft diameter "D" shown in FIG. 21 so that the end section 232 is of smaller diameter as compared to the diameter of the milling shaft. This smaller diameter assists in the amplitude of authorized mis-alignment of the pilot mill relative to the milling shaft. The spherical end member 230 is located at the terminal end of the milling shaft end section 232 so that the pilot mill 192 is freely pivotal about pivot point "P" and thus can be positioned by the deflector guide surface 210 to provide essentially for steering of the milling shaft 194 along an exit angle for casing window milling as determined by the angle of the guide surface 210 of the deflecting body 212.

According to the embodiment shown in FIGS. 20 and 21 it is appropriate to permit articulation of the pilot mill relative to the generally rigid milling shaft 194 for the purpose of self steering of the pilot mill by its guided and stabilized contact with the inclined guide surface 210. The steering and rotational stability of the pilot mill 192 is initially achieved by the generally tubular guide bearing of the deflecting body 18 which is shown at 34 in FIGS. 1 and 3. When the deflecting element is of elongate, tubular configuration as shown at 154 in FIG. 16, the tubular guide bearing for the pilot mill will be as shown at 166. This guide bearing establishes precision orientation and rotational stabilization of the pilot mill along the exit angle defined by the deflecting member so that a precision pilot window opening will be milled in the well casing at the initial stage of casing window milling as discussed above in connection with FIGS. 1–19. Thus it is intended to be understood that the pilot mill 192 shown in FIGS. 20 and 21 will be initially guided and stabilized in the same manner and for the same purpose as discussed above.

According to FIGS. 20 and 21, and as stated above, it is desirable that the pilot mill 192 have freedom of articulation relative to the milling shaft 194 under conditions of initial casing window milling and that the pilot mill have the capability of being maintained in substantially coaxial relation with the milling shaft when desired so that straight milling along the intended trajectory from the casing window can be readily controlled. To accomplish this feature, the end section 232 of the milling shaft 194 is provided with a circular locking flange or enlargement 234. A tubular locking piston 236 is located within the internal chamber of the stabilizing sleeve 198 and is sealed with respect to an internal cylindrical surface 238 by a circular sealing element 240 and sealed with respect to an external cylindrical surface 242 of a tubular extension 244 of the bushing support housing 220 by a circular sealing element 246. The locking piston 236 functions cooperatively with the tubular bushing support housing 220 and its tubular extension 244 and with the internal cylindrical surface 238 of the stabilizing sleeve 198 to define a hydraulic chamber 248. In the freely pivotal condition of the pilot mill 192 relative to the milling shaft 194 shown in FIG. 20, the hydraulic chamber 248 will be filled with hydraulic fluid which is introduced into the hydraulic chamber through one or more hydraulic fluid passages 250 which are in communication with one or more hydraulic fluid passages 252 that are formed in the circular pilot head 196. The hydraulic fluid passage or passages 252 is normally closed by a frangible closure element 254 shown in FIG. 20. This frangible closure element maintains the hydraulic fluid within the hydraulic fluid chamber 248 and thus prevents movement of the locking piston 236 so that the locking piston remains in the position shown in FIG. 20 with its internal locking surface 256 in axially displaced relation with the circular locking flange 234 of the milling shaft end section 232. A tension spring 258 is located within the internal chamber defined by the stabilizing sleeve 198 of the pilot mill 192 with one of its ends 260 and retained relation with a cylindrical shoulder 262 of the bushing support housing 220. The opposite end 264 of the tension spring 258 is fixed within spring grooves defined by a circular shoulder 266 of the locking piston 236. In the relaxed condition of the tension spring as shown in FIG. 21, the locking piston 236 will be positioned with its internal locking surface 256 in registry with the circular locking flange 234 of the milling shaft. In this condition the pilot mill 192 is secured by the locking piston against articulation relative to the milling shaft. In this condition the longitudinal axes of the milling shaft and the pilot mill will be in coincidence and therefore the pilot mill will mill a straight course that is in alignment with the longitudinal axis of the milling shaft.

When casing window milling is initiated and during milling of a pilot window opening in the well casing it is desirable that the pilot mill 192 be disposed in articulating relation with the milling shaft so that the pilot mill is efficiently guided by the inclined guide surface 210 of the deflecting body 212. As long as the frangible closure member 254 remains intact, the hydraulic fluid that is present within the hydraulic chamber 248 will maintain the locking piston positioned as shown in FIG. 20, thus permitting articulation of the pilot mill about the spherical end member 230 of the milling shaft. When it is desired to lock the pilot mill in non-articulating or coaxial relation with the milling shaft the frangible closure 254 is broken away, thereby permitting the tension spring force of the locking piston to discharge some of the hydraulic fluid from the hydraulic chamber 248 through the passages 250 and 252 and through the opening 266. When this occurs, the tension spring 258 will shift the locking piston 236 from the unlocking position of FIG. 20 to the locking position of FIG. 21. Thus, the frangible closure 254 functions as a "locking trigger" that can be actuated in any suitable manner to release hydraulic chamber 248. The locking trigger may be actuated mechanically simply by moving the pilot mill into contact with certain deflector structure or with casing or formation structure, depending upon the configuration thereof. As the pilot mill is moved along the inclined guide surface of the deflection body so that the center of the milling head of the pilot mill is in registry with the casing, the frangible closure will be broken away by contact with the casing, releasing the hydraulic fluid from the chamber 248 and allowing spring urged movement of the locking piston 236 to the FIG. 21 position. Alternatively, the locking trigger may conveniently take the form of a pressure responsive closure, thereby permitting it actuation responsive to conditions of downhole fluid pressure. As a further alternative, the locking trigger may take the form of a valve closure that may be selectively opened by an on-board valve actuator responsive to any suitable fluid telemetry signals.

In a further alternative embodiment, shown in FIG. 22, the inclined contoured guide surface 30 does not extend to the periphery of the deflecting tool at its lower end. Thus, the deflecting tool 12 defines a bearing surface 300 at the lower end of the guide surface 30 that extends from the lower end of the guide surface 30 to the periphery of the deflecting tool 12. The guide surface 30 is preferably slightly convexly arcuate.

In this embodiment, the intent is to mill the window in the casing, then remove the milling tool 14 and deflecting tool 12 from the well and to use a drilling deflector and drilling tool to complete the drilling of the lateral. At least a portion of the milling tool 14 remains within the casing when using the embodiment of FIG. 22. Thus, the guide surface 30 of the deflecting tool 12 defines a milling path that limits the travel of the milling tool to substantially prevent the milling tool from exiting the well casing. The bearing surface 300 provides a stop to define the bottom of the milled window and to stop further milling by the milling tool 14. The convexly arcuate milling surface 30 forces the pilot mill 34 out through the casing initially at a relatively higher rate. Then, once the pilot mill (or the string mills) is at the desired position offset from the centerline of the casing to mill the window of the desired width, such as when the center and widest diameter of the pilot mill 34 (or string mills) is aligned with the casing, the milling surface 34 directs the pilot mill downward along a milling path that is parallel to the centerline of the casing or along a similar path intended to maintain the desired milling width of the pilot mill 34 and the trailing string mills. Thereby, the arcuate milling surface 34 facilitates milling of a window having a width that has the desired width along a longer length than if the milling surface 30 were straight, or linear. In one embodiment, the centerline of the pilot mill 34 remains within the periphery of the well casing.

One advantage to maintaining the milling tool 14 at least partially within the casing is that the direction and orientation of the pilot mill is maintained and the pilot mill 34 is substantially prevented from travelling sideways. Prior efforts that have a guide surface 30 that extends to the periphery of the deflecting tool 12 force the mill further through the casing reducing the aligning support offered by the casing. However, the present invention maintains relatively more of the mill in the casing so that the casing provides guiding support to the mill and reduces walk-away suffered by prior milling designs. Walk-away, a problem known in the art to be associated with prior designs, in which the torque of the mill causes the mill to travel radially as well as axially, produces a window in which the centerline of the milled window is not aligned with the axial direction of the borehole. For example, one common problem resulting from walk-away is that the bottom of the milled window is offset from the centerline of the main portion window through which the lateral is accessed. Such a window may affect reentry because many prior designs use the bottom of the milled window to hang reentry tools. If the bottom of the window is offset from the main portion of the window, the orientation of the reentry tool may be incorrect and prevent effective reentry into the lateral.

Further, the milling tool 14 is adapted and designed for milling steel or other metals or materials forming the casing, not for drilling in a formation necessarily. Thus, drilling tools are better suited for drilling the lateral in the formation once the window is formed in the casing. Accordingly, using the embodiment shown in FIG. 22, in which the milling tool 14 remains at least partially within the casing, the milling tool 14 is used for its optimal purpose (milling a window in the casing) and drilling tools are then used to form the lateral. The resulting milled window using this embodiment builds a side pocket suitable for further construction of the lateral.

Additionally, using the embodiment shown in FIG. 22, produces a window 302 having the general shape as shown in FIG. 23. As discussed, the width of the window 302 widens relatively rapidly at its top and then stabilizes at the desired width. Further, the pilot mill 34 mills a bottom narrow portion 304. The narrow portion 304 is relatively narrow as compared to the portion of the milled window 302 adjacent the narrow portion 304. The narrow portion may be useful for attaching equipment to the casing, such as liners, liner hangers, and other completion or downhole equipment. Additionally, the bottom of the resulting milled window 302 is relatively flat as compared to those milled using the embodiment shown in FIG. 3 for example. The relatively flatter bottom also facilitates use of the casing for attachment of other components.

Alternative Embodiment of the Pilot Mill including Core Breaking Mechanism

An alternative embodiment of the pilot mill 34 is shown in FIGS. 24 and 25. In many milling applications, the center of the relevant mill has a velocity of zero relative to the surface to be milled. This creates unfavorable cutting conditions, often resulting in the destruction of the central portion of the mill and the interruption of the milling process. The illustrated embodiment of pilot mill 34 solves this problem and increases the rate of penetration and durability of the mill in the casing as well as the possibility of milling a window using only one trip of the drill string.

In this embodiment, pilot mill 34 includes a core breaking mechanism 498 that preferably comprises a core passage 500 and a breaking mechanism 502. Core passage 500 extends from the mill nose 78 to the outer guided periphery 36 of the pilot mill 34. Preferably, core passage 500 is included entirely within mill head structure 35. Breaking mechanism 502 is located within core passage 500 and is adapted to break up solid pieces that travel through core passage 500. In the preferred embodiment, breaking mechanism 502 comprises a diverting slope 504 within core passage 500. The diverting slope 504 diverts the core passage 500 from being substantially parallel to the axis of rotation of pilot mill 34 to being directed generally towards the outer guided periphery 36 of pilot mill 34. In the preferred embodiment, diverting slope 504 is constructed from a material that is substantially harder than the material to be milled. Preferably, diverting slope 504 is hardfaced with carbide or another suitable material.

Core passage 500 can have a variety of configurations, so long as the passage 500 provides communication between the mill nose 78 and the outer guided periphery 36. In the embodiment shown in FIG. 24, core passage 500 comprises a core opening 506 having a first end 508 at mill nose 78 and a second end 510 at the outer guided periphery 36. Alternatively and as shown in FIG. 25, core passage 500 comprises a core channel 512 that is open to the tapered milling face 76.

The core passage 500 is preferably configured on mill head structure 35 so that it does not interfere with the operation of the fluid circulation passages 80 or the fluid supply manifold passage 82. The embodiment shown in FIG. 26 shows five fluid circulation passages 80 and the core passage 500 functioning independently from each other.

In the preferred embodiment, the core passage 500 extends from mill nose 78 to outer guided periphery 36 in an arcuate radial path. FIG. 26 clearly shows that core passage 500 does not extend linearly from mill nose 78 to outer guided periphery 36. Instead, the core passage 500 follows an arcuate path along the radial direction from mill nose 78 to outer guided periphery 36. Also preferably, the curve of the radial arcuate shape of core passage 500 extends in the direction of rotation of pilot mill 34.

In operation, the rotating pilot mill 34 is moved towards the appropriate surface. The abrasive inserts on the pilot mill tapered milling surface 76 begin milling the surface. The presence of core passage 500 on mill nose 78 creates a core of non-milled surface that is received within core passage 500 as pilot mill 34 continues the milling process. The core of non-milled surface grows in length within core passage 500 until it hits diverting slope 504. Diverting slope 504 acts to continuously break the core of non-milled surface into pieces as the core is fed through the core passage 500. The broken-up core of non-milled surface is then expelled through the outer guided periphery 36 end of the core passage 500, at which point it joins the remainder of the debris that results from the milling operation.

Alternative Embodiment of the Unitary or Integrated Assembly for Deployment Purposes FIGS. 3, 6, and 7 illustrate one embodiment of the casing window milling assembly 10 in which the deflecting tool 12 is attached to the milling tool 14 during the downhole deployment process. This embodiment includes releasable fasteners such as shear screws 113 and 114 in the tubular guide bearing 32 so as to resist both rotary and linear motion of the pilot mill 34 and the milling shaft 62 relative to the deflecting tool 12.

FIGS. 27 and 28 illustrate an alternative embodiment of a unitary or integral casing window milling assembly 10. This embodiment includes a first retaining mechanism 600, a second retaining mechanism 602, and preferably a protection mechanism 604. In this embodiment, pilot mill 34 is preferably secured at least partially within guide bearing 32.

First retaining mechanism 600 is attached to the drift guide surface 33 so that it is adjacent the pilot mill rear end 606. In the preferred embodiment, first retaining mechanism 600 comprises a first retaining member 608 (FIG. 28) that is securely attached to the drift guide surface 33, such as by threading, welding, or by other means known in the art. First retaining member 608 is shown in FIG. 28 as having a ring shape, although first retaining member 608 can have any shape (such as a half ring or an arcuate segment) provided that first retaining member 608 supports pilot mill 34 in place. In another embodiment as shown in FIG. 27, first retaining mechanism 600 comprises at least one securing screw 610 that is inserted through tubular guide bearing 32 so that it protrudes from drift guide surface 33 next to pilot mill rear end 606.

Second retaining mechanism 602 is attached to the drift guide surface 33 or the inclined guide surface 30 so that it is adjacent the pilot mill front end 612. In the preferred embodiment, second retaining mechanism 602 comprises a second retaining member 614 that is securely attached to the drift guide surface 33 or the inclined guide surface 30, such as by threading, welding, or by other means known in the art. Second retaining member 614 is shown in FIGS. 27 and 28 as having a general ring shape, although second retaining member 614 can have any shape (such as a half ring, a disc, or a half disc) provided that second retaining member 614 supports pilot mill 34 in place. In one embodiment and as shown in the Figures, the second retaining member rear end 620 mirrors the tapered shape of tapered milling face 76.

Protection mechanism 604 is located intermediate the pilot mill 34 (pilot mill front end 612) and the second retaining mechanism 602. Protection mechanism 604 protects the abrasive inserts of pilot mill 34 which are included on tapered milling face 76 from hitting the second retaining member rear end 620 during the deployment process. In one embodiment as shown in FIG. 27, protection mechanism 604 comprises a protection screw 622 that is embedded in tapered milling face 76 (or pilot mill front end 612). Protection screw 622 includes a screw head 624 that extends farther from pilot mill front end 612 than the abrasive inserts of pilot mill 34. Screw head 624 is adjacent second retaining member 620. In another embodiment as shown in FIG. 28, protection mechanism 604 comprises a resilient member 626 that is disposed intermediate tapered milling surface 76 (and abrasive inserts) and second retaining member rear end 620. Resilient member 626 is constructed from a resilient material such as rubber. In the preferred embodiment and as shown in FIG. 33, resilient member 626 includes a plurality of cuts or serrations 710 extending from the center portion 712 preferably to the outer circumference 714 of the resilient member 626. Cuts 710 also preferably extend axially through the resilient member 626 and are spaced about the center portion 712.

In operation, casing window milling assembly 10 is deployed downhole with the pilot mill 34 secured to the drift guide surface 33 and/or the inclined guide surface 30 by use of the first retaining mechanism 600, the second retaining mechanism 602, and the protection mechanism 604. First retaining member 608 aids in maintaining pilot mill 34 in its proper place, supports the load of pilot mill 34 as the casing milling assembly 10 is deployed downhole, and reacts forces applied to pilot mill 34 that are in the downward direction. Second retaining member 614 aids in maintaining pilot mill 34 in its proper place and reacts forces applied to pilot mill 34 that are in the upward direction. Protection mechanism 604 protects the abrasive inserts of tapered milling face 76. If the casing window milling assembly 10 is jarred during the deployment process, pilot mill 34 tends to be forced against second retaining member 614 which event would damage the abrasive inserts, if not for the presence of protection mechanism 604. Protection mechanism 604 absorbs the force caused by the jarring event and thus prevents the abrasive inserts from being damaged. In the embodiment including the protection screw 622, protection screw 622 absorbs the jarring force since the screw head 624 extends farther from the pilot mill front end 612 than the abrasive inserts. In the embodiment including resilient member 626, resilient member 626 absorbs the jarring force due to its resilient material construction.

After the deflecting tool 12 has been properly oriented and set within the well casing, the milling operation may be initiated by applying sufficient rotational force to the pilot mill 34. The rotation of the pilot mill 34 causes the general disintegration of first retaining mechanism 600, second retaining mechanism 602, and protection mechanism 604. Thus, the elements that comprise first retaining mechanism 600, second retaining mechanism 602, and protection mechanism 604 are constructed from materials that can be easily milled by pilot mill 34 and string mills 88 and 90. Adequate materials include steel and aluminum, and rubber for resilient member 626. In the embodiment including resilient member 626 with cuts 710, the cuts 710 weaken resilient member 626 in the direction of rotation enabling the efficient disintegration of the resilient member 626. Once first retaining mechanism 600, second retaining mechanism 602, and protection mechanism 604 are disintegrated, the milling operation continues as previously disclosed.

In another embodiment as shown in FIG. 29, second retaining mechanism 602 comprises a drillable material plug 630 that extends from adjacent the pilot mill front end 612 towards the downhole end of deflecting tool 12. Preferably, drillable material plug 630 fills the entire area within deflecting tool 12 that is at least partially defined by inclined guide surface 30. Drillable material plug 630 preferably completes the outer cylindrical shape of deflecting tool 12. Drillable material plug 630 is constructed from a material that can be easily milled by pilot mill 34 and string mills 88 and 90, such as a plastic or soft steel.

In addition to the utility described above (as second retaining mechanism 602), drillable material plug 630 also improves the efficiency, control, and reliability of the initial phase of the milling operation. First, as is well-known in the art, milling operations are more controllable and predictable if the entire milling face of the mill is in contact with a millable surface. Second, the fact that the entire milling face of the mill is in contact with a millable surface also provides continuous cooling of the pilot mill 34 by providing a continuous flow of debris through side channels 40.

After the deflecting tool 12 has been properly oriented and set within the well casing, the milling operation may be initiated by applying sufficient rotational force to the pilot mill 34. The rotational motion disintegrates first retaining mechanism 600 and protection mechanism 604. The pilot mill 34 then begins to mill drillable material plug 630. At first, the entire milling face of pilot mill 34 contacts and mills drillable material plug 630. As pilot mill 34 moves along inclined guide surface 30, at least a section of the pilot mill 34 contacts the target casing so that the milling face mills both the target casing and the drillable material plug 630. Thus, at all times, the entire surface of the milling face is in contact with a millable material (either the casing wall or the drillable material plug 630) thereby enabling the additional utility disclosed in the previous paragraph.

Also in the preferred embodiment, the portion of guide bearing 32 that is milled away during the milling process is constructed from a material that is softer than the material that comprises the remainder of the deflecting tool 12. In the preferred embodiment, such a portion of guide bearing 32 is annealed prior to use.

Retrievability of Deflecting Tool

Once the milling operation is concluded, a retrieving tool 650 may be inserted into the wellbore to retrieve deflecting tool 12. The interconnection between retrieving tool 650 and deflecting tool 12 is illustrated in FIGS. 30 and 31. It is noted that the deflecting tool 12 shown in FIG. 30 is hollow, unlike the deflecting tools 12 shown in the prior figures. Whether deflecting tool 12 is hollow or not is not critical for the purposes of this invention and either embodiment is encompassed thereby.

Deflecting tool 12 includes a slot 652 preferably defined on inclined guide surface 30. Slot 652 includes a main section 654, preferably rectangular in shape, and a wedge section 656. In the preferred embodiment, wedge section 656 is proximate the uphole end of deflecting tool 12 so that the wide end 658 of wedge section 656 is proximate main section 654 and the narrow end 660 of wedge section 656 is distal thereto. In those embodiments in which deflecting tool 12 is not hollow, slot 652 should extend from the inclined guide surface 30 to the outer surface of the deflecting tool 12.

Retrieving tool 650 includes a hook member 662 extending therefrom. In the preferred embodiment, hook member 662 is selectively removable from retrieving tool 650. The selective removability of the hook member 662 is enabled by any means known in the art, such as fasteners to retrieving tool 650 or a tongue and groove system with a lock. The removability of hook member 662 facilitates the transportation and cleaning, among others, of the hook member 662.

Hook member 662 comprises a first section 664 and a second section 666. First section 664 extends from retrieving tool 650, preferably radially therefrom, towards second section 666. Second section 666 is connected to first section 664, preferably distal to deflecting tool 12. Hook member 662 is sized and constructed so that it may be selectively inserted into slot 652. Thus, in the preferred embodiment, the longest portion of hook member 662 is not longer than the longest portion of main section 654, and the widest portion of hook member 662 is not wider than the widest portion of main section 654.

Second section 666 includes a ramping surface 668 that preferably faces the deflecting tool 12 and is proximate the uphole end of deflecting tool 12. Preferably, the ramping surface uphole end 670 extends past or farther uphole than the first section uphole end 672. Also preferably, the ramping surface side ends 676 extend past or farther laterally than the first section side ends 674. When deflecting tool 12 is properly positioned downhole, the uphole edges 696 of slot main section 654 extend at an angle a from the casing wall. In addition, when retrieving tool 650 is located downhole so that the second section distal end 678 (or hook member distal end) abuts the casing wall, ramping surface 668 extends at an angle $\beta$ from the casing wall. In the preferred embodiment, angle $\beta$ is greater than angle $\alpha$. Furthermore, the retrieving tool 650 is preferably constructed so that the distance between the second section distal end 678 and the retrieving tool side 684 that is laterally opposite the second section distal end 678 is slightly smaller than the drift diameter of the casing.

Also in the preferred embodiment, first main section 664 is at least partially tapered towards the first section uphole end 672. The taper angle θ of first section 664 preferably matches the angle δ defined by wedge section 656. It is not necessary, although it is possible, for the length of the first section tapered surfaces 680 to equal the length of the wedge section surfaces 682.

Retrieving tool 650 preferably also includes a cleaning mechanism 686, which may comprise a retrieving tool opening 688 and at least one port 690. Retrieving tool opening 688 is in fluid communication with a cleaning fluid pressurized source at the surface. Each port 690 extends through hook member 662 and provides fluid communication between the retrieving tool opening 688 and the exterior of retrieving tool 650 adjacent second section distal end 678. A jet nozzle 694 is preferably included within each port 690.

FIG. 32 illustrates an isometric view of retrieving tool 650. Retrieving tool 650 includes a longitudinal axis 700, a first perpendicular axis 702 from longitudinal axis 700, and a second perpendicular axis 704 from longitudinal axis 700. First perpendicular axis 702 extends from longitudinal axis 700 so that a plane including first perpendicular axis 702 and being perpendicular and transverse to longitudinal axis 700 passes through hook member 662. Second perpendicular axis 704 extends from longitudinal axis 700 so that it is perpendicular to first perpendicular axis 702. Retrieving tool 650 is preferably constructed so that the moment of inertia with respect to the second perpendicular axis 704 is substantially greater, and preferably at least three times greater, than the moment of inertia with respect to the first perpendicular axis 702.

In operation, once the milling operation has been completed, the retrieving tool 650 is inserted downhole. The cleaning mechanism 686 is activated so that cleaning fluid is injected from the surface through retrieving tool opening 688 and out through each port 690. The pressure monitored at the fluid pressurized source located at the surface remains constant until the retrieving tool 650 is adjacent the deflecting tool 12. At this point, the monitored pressure will decrease somewhat as the retrieving tool 650 continues along the inclined guide surface 30. This change in pressure alerts the operator that the retrieving tool 650 has reached the deflecting tool 12. The monitored pressure will bottom out when the hook member 662 is adjacent the slot 652 since the flow of cleaning fluid immediately out of ports 690 is not obstructed by the casing wall or the inclined guide surface 30, as before. The large pressure drop indicates to the operator that the hook member 662 is adjacent the slot 652. The jet nozzles 682 will of course clean the slot 652 as they pass thereby, which enables the proper insertion of hook member 662 therein. At this point, the operator may manipulate the retrieving tool 650 so that hook member 662 is inserted into slot 652. The pressurized fluid flowing out of the pressurized fluid source, through the retrieving tool opening 688 of the retrieving tool body, and through each port 690 as well as the pressure gauge operatively connected to the retrieving tool opening 688 comprise a hydraulic signature mechanism. The hydraulic signature mechanism enables an operator to monitor the pressure of fluid out of ports 690 and therefore enables an operator to monitor the location of the retrieving tool 650 in relation to the deflecting tool 12, as previously disclosed.

FIGS. 30 and 31 illustrate the initial insertion position of the hook member 662 relative to the slot 652. Once this initial insertion is achieved, the operator should begin to slowly retrieve the retrieving tool 650. This motion enables the ramping surface 668 to contact the uphole edges 696 of slot main section 654. Since second section distal end 678 abuts the casing wall, continued upward motion of the retrieving tool 650 causes the uphole edges 696 of slot main section 654 to ramp or slide on ramping surface 668. And, since the angle β of ramping surface 668 is greater than the angle α of the uphole edges 696, the continued upward motion of the retrieving tool 650 causes the uphole end of the deflecting tool 12 to be lifted away from the segment of casing wall it was previously abutting. This upward motion also results in the first section 664 entering wedge section 656 and the first section tapered surfaces 680 mating with the wedge section surfaces 682. Hook member 662 is thus secured within slot 652 by the interaction between ramping surface 668 and uphole edges 696 and the interaction between first section tapered surfaces 680 and wedge section surfaces 682.

The fact that the uphole end of the deflecting tool 12 is lifted away from the relevant segment of casing wall greatly facilitates the retrieval of the deflecting tool 12. Without such a lifting motion, the uphole end of the deflecting tool 12 can easily jam against a variety of downhole objects, such as collars or debris, during the retrieval process. Further complications arise if the wellbore is deviated and the uphole end of the deflecting tool 12 must maneuver bends in the casing wall. By lifting the uphole end of the deflecting tool 12, the retrieving tool 650 greatly reduces the chances of the deflecting tool 12 jamming during the retrieval process.

Furthermore, the fact that hook member 662 and slot 652 are engaged along the lengths of first section tapered surfaces 680 greatly increases, over the known prior art, the amount of surface area that is in contact between the retrieving tool 650 and the deflecting tool 12. The prior art typically includes a hook and slot combination that are engaged only at the portion corresponding to the wedge section narrow end 660. By increasing the surface area of engagement, a greater amount of lifting load may be applied during the retrieval process. In addition, by engaging the hook member 662 and slot 652 at tapered surfaces, 680 and 682, much less relative movement between the retrieving tool 650 and the deflecting tool 12 is exhibited during the retrieval process.

The fact that the distance between the second section distal end 678 and the retrieving tool side 684 is slightly smaller than the drift diameter of the casing also facilitates the retrieval of deflecting tool 12. If the difference between the two dimensions is substantial, then there is enough space for the hook member 662 to become disengaged from the slot 652, specially if a jarring event occurs during the retrieval process. On the other hand, even if a jarring event occurs while using retrieving tool 650, the minimal space provided by the relative dimensions of the retrieving tool 650 and the casing drift diameter greatly inhibits, if not abolishes, the chances of disengagement.

Throughout the use of the retrieving tool 650, the hook member 662 may be pressed against the casing wall as shown in FIG. 30. Due to the fact that the moment of inertia with respect to the second perpendicular axis 704 is substantially greater, and preferably at least three times greater, than the moment of inertia with respect to the first perpendicular axis 702, the retrieving tool 650 tends to bend about the second perpendicular axis 704. This movement facilitates the insertion of hook member 663 into slot 652 as well as the retrieval of deflecting tool 10.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

What is claimed is:

1. An assembly comprising:

a retrieving tool including a hook member;

a deflecting tool including a slot and an uphole end, the deflecting tool having a body defining a side surface to generally face a casing wall;

the hook member selectively insertable and engageable within the slot, the hook member having a ramping surface; and the slot of the deflecting tool having an edge adapted to slide on the ramping surface of the hook member, the ramping surface generally facing the side surface of the deflecting tool once the hook member is positioned through the slot the deflecting tool uphole end being lifted away from a segment of the casing wall as the edge of the slot slides on the ramping surface.

2. The assembly of claim 1 wherein:

the edge of the slot is adapted to ramp on the ramping surface as the hook member is inserted and engaged within the slot and the retrieving tool is retrieved; and wherein a ramping motion of the edge on the ramping surface causes the deflecting tool uphole end to be lifted away from the casing wall segment.

3. The assembly of claim 1, wherein the body defines another side surface, the slot extending through the body between the side surfaces.

4. The assembly of claim 3, wherein the slot extends from a first opening in one of the side surfaces to a second opening in the other one of the side surfaces.

5. The assembly of claim 1, wherein the slot has another edge adapted to slide on the ramping surface of the hook member.

6. The assembly of claim 1, wherein the hook member has a first section and a second section, the second section providing the ramping surface, wherein the ramping surface has an uphole end that extends farther uphole than an uphole end of the first section.

7. The assembly of claim 6, wherein the first section has tapered surfaces, and wherein the slot has a wedge-section having wedge section surfaces, the first section tapered surfaces adapted to contact the wedge section surfaces when the hook member is inserted and engaged within the slot.

8. The assembly of claim 1, wherein the hook member has a surface adapted to engage the casing wall.

9. The assembly of claim 1, wherein the retrieving tool has a hydraulic signature mechanism adapted to indicate if the retrieving tool hook member is positioned proximate the slot of the deflecting tool.

10. The assembly of claim 9, wherein the hydraulic signature mechanism comprises a hydraulic port through which fluid is adapted to flow, a change in pressure of the fluid to indicate that the hook member is positioned proximate the slot.

11. The assembly of claim 10 wherein the hydraulic signature mechanism has at least another hydraulic port.

12. The assembly of claim 1, wherein the hook member has a distal end, and the retrieving tool has a side laterally opposite the hook member distal end, wherein the distance between the hook member distal end and the retrieving tool side is slightly smaller than a drift diameter of the casing.

13. The assembly of claim 1, wherein the hook member has a longitudinal axis, wherein the retrieving tool has a first perpendicular axis extending from the longitudinal axis so that a plane including the first perpendicular axis is perpendicular and transverse to the longitudinal axis of the hook member, and the retrieving tool has a second perpendicular axis extending from the longitudinal axis, the second perpendicular axis being perpendicular to the first perpendicular axis, and wherein a moment of inertia with respect to the second perpendicular axis is substantially greater than a moment of inertia with respect to the first perpendicular axis.

14. The assembly of claim 13, wherein the moment of inertia with respect to the second perpendicular axis is at least three times greater than the moment of inertia with respect to the first perpendicular axis.

15. The assembly of claim 1, wherein the retrieving tool further has a cleaning mechanism including at least one port, each port extending through the hook member.

16. The assembly of claim 1, wherein the retrieving tool has a port and a pressure gauge operatively coupled to the retrieving tool port to monitor a pressure of fluid therein.

17. A method for retrieving a deflecting tool by use of a retrieving tool, comprising:

running the retrieving tool to the location of the deflecting tool;

engaging a hook member of the retrieving tool to a slot of the deflecting tool, the deflecting tool having a body defining a side surface generally facing a casing wall;

providing a ramping surface on the hook member of the retrieving tool, the ramping surface generally facing the side surface of the body once the hook member is inserted through the slot;

sliding an edge of the slot on the ramping surface as the retrieving tool hook member is engaged in the slot; and lifting the uphole end of the deflecting tool away from a segment of the casing wall as the edge of the slot slides on the ramping surface.

18. The method of claim 17, wherein the body defines another side surface, the method further comprising extending the slot through the body between the side surfaces.

19. The method of claim 17, further comprising sliding another edge of the slot on the ramping surface.

20. The method of claim 17, wherein the hook member has a first section and a second section, the second section providing the ramping surface, the method further comprising extending an uphole end of the ramping surface farther uphole than an uphole end of the first section.

21. The method of claim 20, further comprising:

providing tapered surfaces on the first section;

providing a wedge section having wedge section surfaces in the slot; and contacting the first section tapered surfaces to the wedge section surfaces when the hook member is inserted and engaged within the slot.

22. The method of claim 17, further comprising:

providing a hydraulic signature mechanism having a hydraulic port through which fluid flows; and monitoring a pressure of the fluid to determine if the hook member is positioned proximate the slot.

23. An assembly comprising:

a retrieving tool including a hook member, the hook member including a first section having tapered surfaces;

a deflecting tool including a slot, the slot including a wedge section having wedge section surfaces;

the hook member selectively insertable and engageable within the slot; and the first section tapered surfaces contacting the wedge section surfaces when the hook member is inserted and engaged within the slot.

24. The assembly of claim 23 wherein:

the taper angle of the first section tapered surfaces matches the angle defined by the wedge section surfaces.

25. A method for retrieving a deflecting tool including a slot by use of a retrieving tool including a hook member, the hook member including a first section having tapered surfaces and the slot including a wedge section having wedge section surfaces, the method comprising:

running the retrieving tool to the location of the deflecting tool; and engaging the first section tapered surfaces with the wedge section surfaces.

* * * * *